US010907903B2

(12) United States Patent
Morimura et al.

(10) Patent No.: US 10,907,903 B2
(45) Date of Patent: Feb. 2, 2021

(54) AIR CONDITIONER WITH FLOW DIRECTION CHANGING MECHANISM

(71) Applicant: Samsung Electronics Co., Ltd., Suwon-si (KR)

(72) Inventors: Hideyuki Morimura, Yokohama (JP); Kenichiro Sato, Yokohama (JP); Hyunyoung Kim, Yokohama (JP)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 50 days.

(21) Appl. No.: 15/399,976

(22) Filed: Jan. 6, 2017

(65) Prior Publication Data

US 2017/0211886 A1 Jul. 27, 2017

(30) Foreign Application Priority Data

Jan. 21, 2016 (JP) ..... 2016-010177
May 4, 2016 (KR) ..... 10-2016-0055219
(Continued)

(51) Int. Cl.
*F28D 1/00* (2006.01)
*F28D 1/053* (2006.01)
(Continued)

(52) U.S. Cl.
CPC ..... *F28D 1/05383* (2013.01); *F25B 39/00* (2013.01); *F28F 1/32* (2013.01);
(Continued)

(58) Field of Classification Search
CPC ..... F28D 1/05383; F28D 2021/0068; F25B 39/00; F28F 1/32; F28F 9/0204;
(Continued)

(56) References Cited

U.S. PATENT DOCUMENTS 3,734,176 A * 5/1973 Hagnauer ..... F28D 7/06 165/158
9,574,806 B2 2/2017 Inoue et al.
(Continued)

FOREIGN PATENT DOCUMENTS

DE 102004033099 1/2005
EP 0566899 10/1993
(Continued)

OTHER PUBLICATIONS

Extended European Search Report dated Sep. 28, 2018 in European Patent Application No. 17741605.4.
(Continued)

*Primary Examiner* — Travis C Ruby
(74) *Attorney, Agent, or Firm* — Staas & Halsey LLP

(57) ABSTRACT

An air conditioner includes a header for introducing refrigerant into a plurality of refrigerant tubes provided in parallel in a vertical direction. The header includes a main header chamber extending in the vertical direction and a plurality of sub header chambers branched in the horizontal direction from the main header chamber and provided in parallel in the vertical direction. The main header chamber includes a refrigerant inlet port configured to introduce the refrigerant in a gas-liquid mixing state in a horizontal direction into an inside of the main header chamber; and a flow direction changing mechanism provided to collide with the refrigerant ejected from the refrigerant inlet port, and configured to change a flow direction of the refrigerant from the horizontal direction to the vertical direction.

20 Claims, 32 Drawing Sheets

(30) Foreign Application Priority Data

Jul. 13, 2016 (JP) ..... 2016-138679
Sep. 26, 2016 (KR) ..... 10-2016-0123335

(51) Int. Cl.
*F28F 9/02* (2006.01)
*F28F 1/32* (2006.01)
*F25B 39/00* (2006.01)
*F28D 21/00* (2006.01)

(52) U.S. Cl.
CPC ..... *F28F 9/0204* (2013.01); *F28F 9/027* (2013.01); *F28F 9/028* (2013.01); *F28F 9/0263* (2013.01); *F28F 9/0265* (2013.01); *F28D 2021/0068* (2013.01); *F28F 2215/12* (2013.01); *F28F 2260/02* (2013.01)

(58) Field of Classification Search
CPC ..... F28F 9/0263; F28F 9/0265; F28F 9/027; F28F 9/028; F28F 2215/12; F28F 2260/02
See application file for complete search history.

(56) References Cited

U.S. PATENT DOCUMENTS

| | | | | |
|---|---|---|---|---|
| 2005/0109492 | A1* | 5/2005 | Kroetsch | F28D 1/05366 165/149 |
| 2006/0102331 | A1 | 5/2006 | Taras et al. | |
| 2006/0191677 | A1 | 8/2006 | Viczena | |
| 2008/0099191 | A1* | 5/2008 | Taras | F25B 39/028 165/174 |
| 2011/0056667 | A1 | 3/2011 | Tares et al. | |
| 2011/0061844 | A1 | 3/2011 | Jianlong et al. | |
| 2012/0291998 | A1* | 11/2012 | Anderson | F28F 9/0243 165/104.14 |
| 2013/0020061 | A1 | 1/2013 | Bergh | |
| 2013/0126140 | A1 | 5/2013 | Park et al. | |
| 2014/0338874 | A1 | 11/2014 | Jindou et al. | |
| 2015/0027672 | A1 | 1/2015 | Jindou et al. | |
| 2016/0327317 | A1 | 11/2016 | Inoue et al. | |

FOREIGN PATENT DOCUMENTS

| | | |
|---|---|---|
| EP | 1798505 | 6/2007 |
| EP | 2778595 A1 | 9/2014 |
| JP | 3298432 | 7/2002 |
| JP | 2005-83725 | 3/2005 |
| JP | 2005-300072 | 10/2005 |
| JP | 2007-155183 | 6/2007 |
| JP | 2010-139088 | 6/2010 |
| JP | 2011-75165 | 4/2011 |
| JP | 5376010 | 12/2013 |
| JP | 2014-37899 | 2/2014 |
| JP | 2014-66502 | 4/2014 |
| JP | 5626254 | 11/2014 |
| JP | 2015-45421 | 3/2015 |
| JP | 5741680 | 5/2015 |
| JP | 2015-127620 | 7/2015 |
| KR | 10-0493694 | 6/2005 |

OTHER PUBLICATIONS

International Search Report and Written Opinion of the International Searching Authority dated May 1, 2017 in International Patent Application No. PCT/KR2017/000303.
Chinese Office Action dated Jul. 1, 2019 in Chinese Patent Application No. 201780004483.4.
Chinese Office Action dated Mar. 9, 2020 in Chinese Patent Application No. 201780004483.4.
European Communication dated Dec. 15, 2020 in European Patent Application No. 17741605.4.

* cited by examiner

AIR CONDITIONER WITH FLOW DIRECTION CHANGING MECHANISM

CROSS-REFERENCE TO RELATED APPLICATIONS

This application claims the priority benefit of Japanese Patent Applications No. 2016-010177 filed Jan. 21, 2016, and No. 2016-138679 filed Jul. 13, 2016 in the Japanese Patent Office, and claims the priority benefit of Korean Patent Applications No. 10-2016-0055219 filed May 4, 2016, and No. 10-2016-0123335 filed Sep. 26, 2016 in the Korean Intellectual Property Office, the disclosures of which are incorporated herein by reference in their entirety.

BACKGROUND

1. Field

The following description relates to an air conditioner provided with a header that is used in a heat exchanger having a plurality of refrigerant tubes and distributes refrigerant to the plurality of refrigerant tubes.

2. Description of the Related Art

Conventional microchannel heat exchangers using a header include a microchannel heat exchanger in which a projection length of each of a plurality of refrigerant tubes formed in a flat tube which projects into the header is optimized according to a flow rate of refrigerant during operation (see Patent Document 1), and a heat exchanger in which a mixing chamber, a distribution chamber, and a distribution passage are formed by providing at least one separating panel parallel to or perpendicular to an axis of a header tube within the header tube (see Patent Document 2).

However, in the header as described in Patent Document 1, the flow resistance due to the tube projection portions of the flat tubes projecting into the header varies according to the flow rate of the refrigerant. Therefore, it is difficult to uniformize the amount of refrigerant flowing into each of the flat tubes with respect to the fluctuating flow rate. Further, when the flat tubes are projected into the header, a swirling occurs in the flow of the refrigerant in the projecting portion so that the refrigerant does not flow smoothly into each of the flat tubes.

Also, in the header of Patent Document 2, because the flow resistance varies, it is difficult to uniformize the amount of refrigerant flowing into each of the flat tubes uniform with respect to the fluctuating flow rate. In addition, when a large number of separating plates are disposed or when the separating plate has a complicated shape, the price thereof is expensive.

Further, as described in Patent Document 3, a plurality of sub header pipes are branched in a horizontal direction from a main header chamber extending in a vertical direction, and a flat tube is connected directly to each of the sub header pipes. This is intended to uniformly distribute refrigerant with respect to each of the flat tubes by distributing the refrigerant flowing into the main header chamber in each of the sub header pipes.

However, because the liquid refrigerant having a large specific gravity easily enters the flat tubes that are located in a lower side, and the gas refrigerant is introduced into the flat tubes that are located in an upper side, the uniform distribution of the refrigerant could not be realized.

PATENT DOCUMENTS

Patent Document 1: Japanese Patent No. 5626254

Patent Document 2: Japanese Patent Publication No. 2014-66502

Patent Document 3: U.S. Patent Publication No. 2012/0291998

SUMMARY

Additional aspects and/or advantages will be set forth in part in the description which follows and, in part, will be apparent from the description, or may be learned by practice of the disclosure.

The present disclosure has been developed in order to overcome the above drawbacks and other problems associated with the conventional arrangement. An aspect of the present disclosure relates to an air conditioner including a header that can evenly distribute refrigerant in a gas-liquid mixing state to each of a plurality of refrigerant tubes that are provided side by side in a vertical direction.

According to an aspect of the present disclosure, a header may include a main header chamber extending in the vertical direction, and may be configured to introduce the refrigerant flowing into the main header chamber into a plurality of refrigerant tubes provided side by side in a vertical direction. The main header chamber may include a refrigerant inlet port configured to introduce the refrigerant in a gas-liquid mixing state into an inside of the main header chamber in a horizontal direction; and a flow direction changing mechanism provided to collide with the refrigerant flowing out from the refrigerant inlet port, and configured to change a flow direction of the refrigerant from the horizontal direction to the vertical direction. Here, the refrigerant tube is a concept including, for example, a flat tube or a circular tube in which the refrigerant flows and performs heat exchange with air.

When the header is configured as described above, the refrigerant in the gas-liquid mixing state flowing into the main header chamber may flow toward an upper portion of the main header chamber by the flow direction changing mechanism, thereby preventing a large amount of refrigerant from flowing into the refrigerant tubes provided in a lower portion of the main header chamber and sufficiently distributing the liquid refrigerant to the refrigerant tubes provided in the upper portion. Also, by reducing the internal volume of the main header chamber, gas-liquid mixing may be promoted even in the case of a low-flow-rate refrigerant in which drifts of the separated gas and liquid refrigerants are likely to occur. Accordingly, the refrigerant may be distributed into the refrigerant tubes in a state in which the gas-liquid mixing ratio is similar to each other, so that the heat exchange efficiency in each refrigerant tube may be made ideal.

A specific structure for distributing the refrigerant in a state in which the liquid refrigerant is sufficiently contained in the refrigerant tubes provided at the upper side among the plurality of refrigerant tubes arranged in parallel in the vertical direction and for preventing the refrigerant from being excessively accumulated in the refrigerant tubes provided at the lower side may include a plurality of sub header chambers branched in the horizontal direction from the main header chamber and arranged in parallel in the vertical direction, wherein the plurality of refrigerant tubes are connected to the plurality of sub header chambers, respectively, so that the refrigerant flowing into the main header chamber is divided into the plurality of refrigerant tubes through the plurality of sub header chambers.

In order to manufacture the header having a structure capable of distributing the refrigerant from the main header chamber to the plurality of sub header chambers in a simple configuration, the main header chamber may be formed by a main header tube extending in the vertical direction, and the plurality of sub header chambers may be formed by a plurality of sub header tubes that are provided in parallel in the vertical direction with respect to an outer side surface of the main header tube.

In order to improve the reliability of refrigerant leakage by forming the main header chamber and the plurality of sub header chambers by omitting a brazing process of joining the plurality of sub header tubes to the main header tube, the main header chamber and the plurality of sub header chambers may be provided inside a single header tube, the main header chamber may be formed by an inner surface of the header tube and a first plate member provided to vertically partition the inside of the header tube, and the plurality of sub header chambers may be formed by the inner surface of the header tube, the first plate member, and a plurality of second plate members provided to horizontally partition the inside of the header tube.

In order to effectively change the flow direction of the refrigerant being introduced from the refrigerant inlet port to the upper side of the main header chamber without complicating the shape of the main header chamber, the refrigerant inlet port may be formed as an opening provided at a lower portion of a side surface of the main header chamber, and the flow direction changing mechanism may be formed in a resistance body extending in the vertical direction from a bottom of the main header chamber inside the main header chamber.

For example, in order that the flow direction changing mechanism can also serve as a structure for stacking two or more main header chambers in the vertical direction, the refrigerant inlet port may be formed as an opening provided at a lower portion of a side surface of the main header chamber, and the flow direction changing mechanism may be formed as a refrigerant collision portion formed by a portion of an inner side surface of the main header chamber facing the refrigerant inlet port.

In order to prevent the refrigerant introduced into the main header chamber from generating swirling in the vicinity of the sub header chambers and to reduce the flow resistance of the refrigerant as much as possible so that the refrigerant flows uniformly into each sub header chamber and each refrigerant tube, the main header chamber may further include a refrigerant flow path extending in the vertical direction and whose a hydraulic diameter is smaller than that of an opening of the refrigerant tube; and a plurality of refrigerant outlet ports connected to the plurality of sub header chambers, respectively, and formed in parallel in the vertical direction, and the plurality of sub header chambers may not protrude into the inside of the main header chamber from the plurality of refrigerant outlet ports.

For example, in order for the refrigerant to flow uniformly from each sub header chamber to each refrigerant tube by limiting the inflow amount of the refrigerant into the sub header chambers provided in the vicinity of the refrigerant inlet port or by controlling the ease of the introduction of the refrigerant into each sub header chamber, at least one of the plurality of sub header chambers may be connected to the main header chamber through a throttling portion having a narrow flow path.

In order to more evenly distribute the amount of refrigerant in the vertical direction inside the main header chamber, the inside of the main header chamber may be partitioned in the vertical direction by at least one throttling plate provided with the throttling portion.

In order to promote uniformity of the amount of refrigerant flowing into each refrigerant tube by preventing the refrigerant from being linearly introduced into the sub header chambers in the vicinity of the refrigerant inlet port, the resistance body may be provided to partition between the refrigerant inlet port and some of the plurality of refrigerant outlet ports.

In order to improve the manufacturability of the header by forming a complicated flow path shape by a simple assembling operation without joining the plurality of sub header chambers to the main header chamber by, for example, brazing or the like, at least two press plates are assembled so that the main header chamber and the plurality of sub header chambers are formed by cavities formed between the two press plates, and each refrigerant tube may be inserted into a through hole formed to penetrate one press plate in a sheet surface direction at a position where the sub header tube is formed. Further, with this configuration, because the refrigerant tubes are only inserted into the sub header chambers, the assemblability is good, and even if the refrigerant tubes are inserted, nothing protrudes into the main header chamber, so that the flow of the refrigerant is not disturbed.

Another manufacturing method for the main header chamber and the sub header chambers may include a method of forming the main header chamber and the sub header chambers by a combination of extrusion-molded members.

In order for the size of the inlets of the sub header chambers to be automatically changed depending on the flow rate of the refrigerant flowing from the refrigerant inlet port so that the refrigerant can be more evenly distributed to each sub header chamber regardless of the flow rate of the refrigerant, at least one tubular member including a first end opened, a second end covered by a cover having a hole, and a side surface on which at least one communication hole in fluid communication with the refrigerant outlet ports is formed may be inserted into the main header chamber, and an inner wall of the main header chamber may be provided with an upper stopper and a lower stopper at upper and lower sides of the tubular member so that the tubular member is capable of moving in the vertical direction in a predetermined range.

For example, in order to allow more refrigerant to flow into predetermined sub header chambers when the flow rate of the refrigerant is small and the force thereof is weak, the tubular member may be designed to be in contact with the lower stopper, so that the communication holes of the tubular member deviate from the sub header chambers.

Conversely, in order to make it difficult for the refrigerant to flow into the predetermined sub header chambers when the flow rate of the refrigerant is large and the force thereof is strong, the tubular member may be designed to be in contact with the upper stopper, so that the communication holes of the tubular member are aligned with the sub header chambers.

In order to prevent the refrigerant introduced from the refrigerant inlet port from linearly flowing into the sub header chambers without colliding with the collision portion and to allow the refrigerant to uniformly flow into the sub header chambers, the refrigerant inlet port may be is provided not to face the refrigerant outlet ports.

For example, in order not to form the throttling portion in advance at the connecting portion between the main header chamber and the sub header chambers but to appropriately adjust the inflow amount of the refrigerant by providing the throttling portion later, the header may further include at least one sub-header inserting tube inserted into at least one of the plurality of sub header chambers, and an end of the sub-header inserting tube may be provided to protrude into the main header chamber.

In order to realize a structure in which the refrigerant uniformly moves from the main header chamber to the plurality of sub header chambers in a simple shape by eliminating the brazing joining process while reducing the manufacturing cost, the header tube may be formed of an electroseamed pipe, the first plate member and the second plate member may be plate materials formed by press processing, and the first plate member and the second plate member may be inserted into the electroseamed pipe.

In a specific structure for forming the main header chamber extending in the vertical direction at low cost, the header tube may have a substantially rectangular or substantially circular cross-section, and the first plate member may be formed in a shape to have a cross-section of a flat plate, a substantially U-shape, or a substantially L-shape.

In order to uniformly distribute the refrigerant in the vertical direction within the main header chamber with a simple structure, the throttling plate may be formed of a plate material having one or a plurality of holes.

The plurality of refrigerant tubes may be connected to a sub header chamber adjacent to the refrigerant collision portion.

The heat exchanger having the header according to the present disclosure and the plurality of refrigerant tubes may uniformly distribute the refrigerant to each refrigerant tube, thereby achieving efficient heat exchange throughout the heat exchanger.

With the header according to the present disclosure as described above, because the flow direction changing mechanism allows the introduced refrigerant to flow in the upper portion of the main header chamber, the refrigerant in the gas-liquid mixing state may be uniformly distributed to the refrigerant tubes of the upper portion as well as the refrigerant tubes of the lower portion. And, because heat exchange can be uniformly performed throughout the heat exchanger, the heat exchange efficiency may be improved over the conventional heat exchanger.

BRIEF DESCRIPTION OF THE DRAWINGS

These and/or other aspects and advantages of the present disclosure will become apparent and more readily appreciated from the following description of the embodiments, taken in conjunction with the accompanying drawings of which.

DETAILED DESCRIPTION

Figure 1:
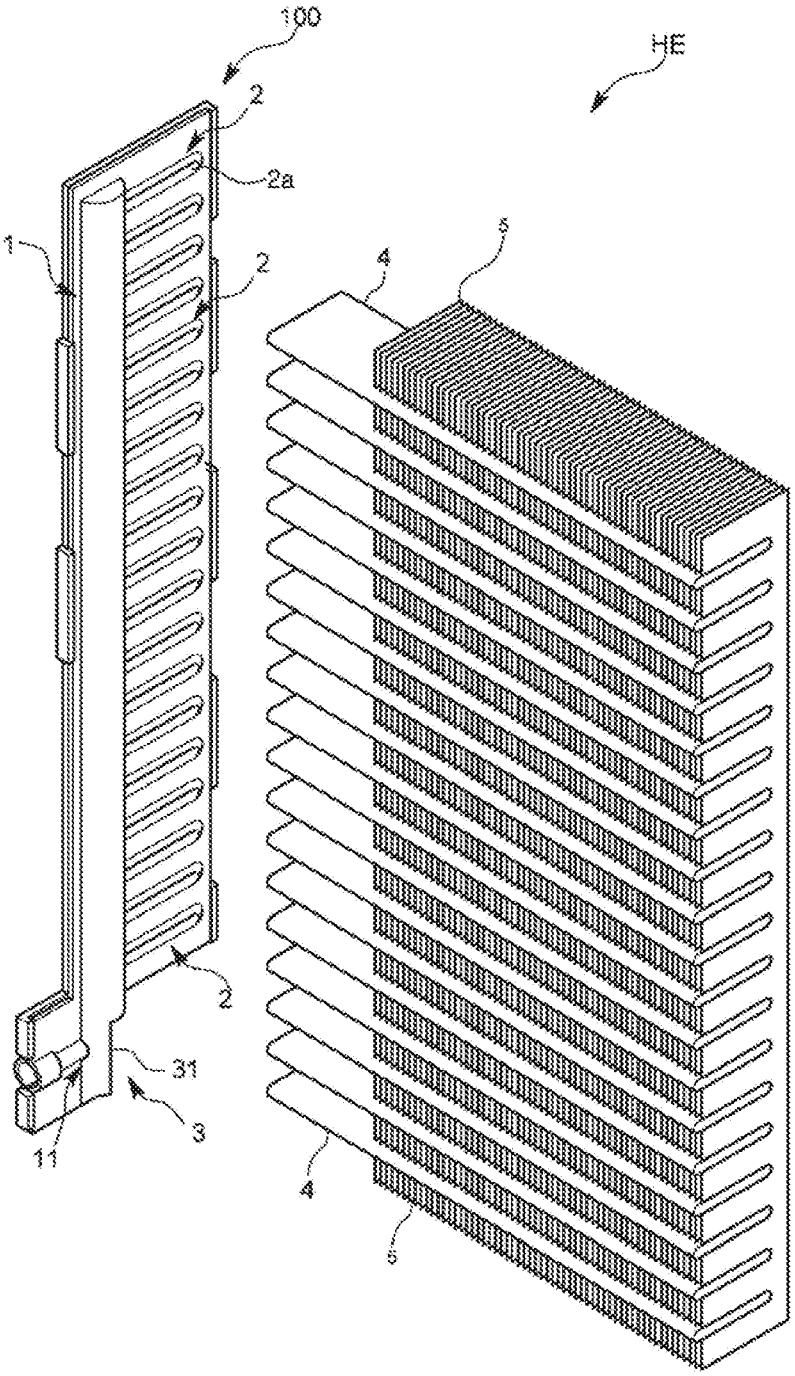
FIG. 1 is a perspective view schematically illustrating a header and a microchannel heat exchanger according to an embodiment of the present disclosure.

Reference will now be made in detail to the embodiments, examples of which are illustrated in the accompanying drawings, wherein like reference numerals refer to like elements throughout. The embodiments are described below to explain the present disclosure by referring to the figures.

Hereinafter, an air conditioner having a header according to exemplary embodiments of the present disclosure will be described with reference to the accompanying drawings.

The matters defined herein, such as a detailed construction and elements thereof, are provided to assist in a comprehensive understanding of this description. Thus, it is apparent that exemplary embodiments may be carried out without those defined matters. Also, well-known functions or constructions are omitted to provide a clear and concise description of exemplary embodiments. Further, dimensions of various elements in the accompanying drawings may be arbitrarily increased or decreased for assisting in a comprehensive understanding.

The terms "first", "second", etc. may be used to describe diverse components, but the components are not limited by the terms. The terms are only used to distinguish one component from the others.

The terms used in the present application are only used to describe the exemplary embodiments, but are not intended to limit the scope of the disclosure. The singular expression also includes the plural meaning as long as it does not differently mean in the context. In the present application, the terms "include" and "consist of" designate the presence of features, numbers, steps, operations, components, elements, or a combination thereof that are written in the specification, but do not exclude the presence or possibility of addition of one or more other features, numbers, steps, operations, components, elements, or a combination thereof.

A header 100 according to an embodiment of the present disclosure and a micro-channel heat exchanger HE using the header 100 will be described with reference to the accompanying drawings.

The micro-channel heat exchanger HE according to the present embodiment, for example, is used in an air conditioner, and, as illustrated in FIG. 1, may include a heat exchanging portion and a header. The heat exchanging portion consists of flat tubes 4 that are alternatively stacked in the vertical direction and fins 5. The flat tubes 4 are refrigerant tubes through which a refrigerant flows. The plurality of flat tubes 4 form the heat exchanging portion, and a plurality of fins are formed on the circumference of each of the plurality of flat tubes 4. The header 100 is formed to distribute the refrigerant with respect to each of the plurality of flat tubes 4, the refrigerant tubes constituting the heat exchanging portion.

Figure 2:
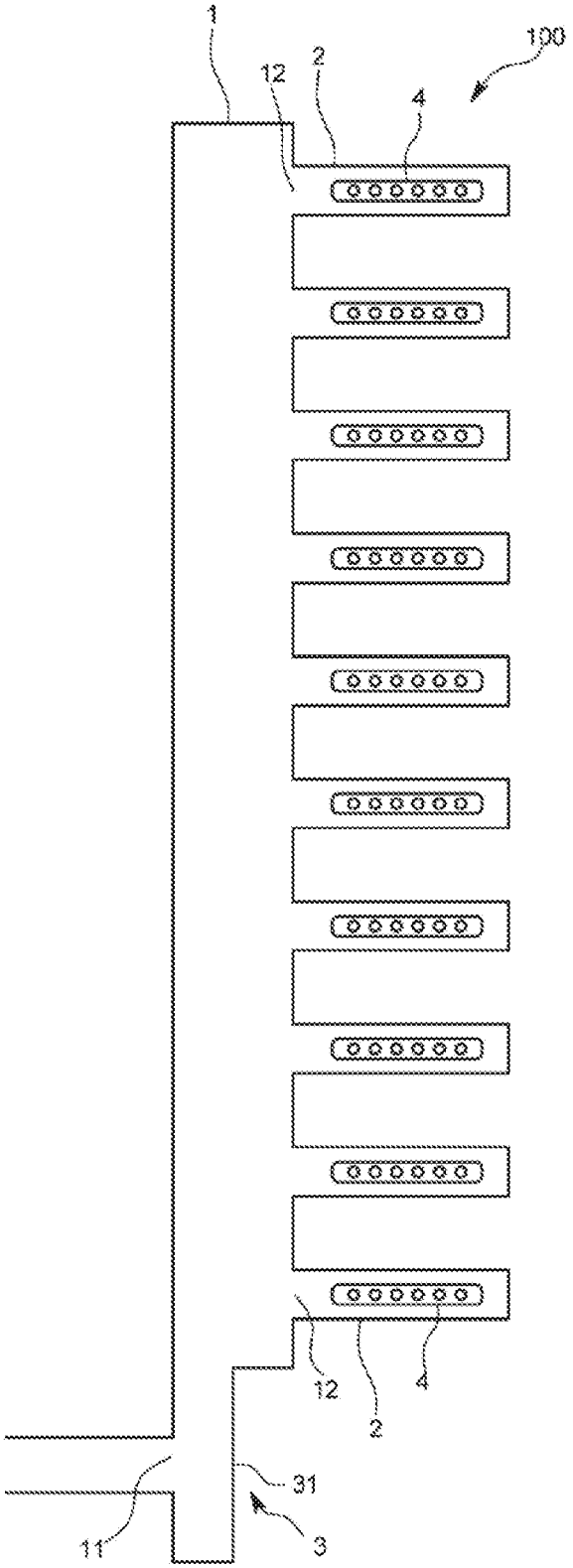
FIG. 2 is a longitudinal sectional view schematically illustrating a structure of a header according to an embodiment of the present disclosure.

As illustrated in FIG. 2, the header 100 includes a main header chamber 1 extending in a vertical direction and a plurality of sub header chambers 2 that are branched in a horizontal direction from the main header chamber 1 and provided side by side in the vertical direction. A side surface of each of the plurality of sub header chambers 2 is provided with a through hole 2*a* into which an end of the flat tube 4 is inserted.

The main header chamber 1 forms a refrigerant flow path, and is formed inside a main header tube having a substantially cylindrical shape except for a lower end portion. An inner side surface of the lower portion of the main header chamber 1 is provided with a refrigerant inlet port 11 which is an opening and connected to a refrigerant inlet pipe, and an inner surface of the main header chamber 1 opposite to the refrigerant inlet port 11 is provided with a plurality of refrigerant outlet ports 12, which are in fluid communication with the plurality of sub header chambers 2, respectively, side by side in the vertical direction. As illustrated in FIG. 1, the refrigerant inlet port 11 is provided below any of the plurality of refrigerant outlet ports 12, and a flow direction changing mechanism 3 for changing the flow of the refrigerant from a horizontal direction to an upward direction is formed in a direction in which the refrigerant is ejected from the refrigerant inlet port 11. In the present embodiment, the flow direction changing mechanism 3 is provided as a refrigerant collision portion 31 formed in the inner surface of the main header chamber 1 facing the refrigerant inlet port 11.

The refrigerant collision portion 31 is provided closer to a central axis of the main header chamber 1 than the refrigerant outlet ports 12 connected to the sub header chambers 2 and adjacent to the refrigerant inlet port 11. Accordingly, the refrigerant ejected from the refrigerant inlet port 11 collides with the refrigerant collision portion 31 at a predetermined speed, and thus the refrigerant in the gas-liquid mixed state is raised within the main header chamber 1 by the force. In other words, the refrigerant flowing into the main header chamber 1 in the horizontal direction through the refrigerant inlet port 11 flows in the vertical direction by the refrigerant collision portion 31, and flows to the upper side of the main header chamber 1.

A hydraulic diameter of the refrigerant flow pass in the vertical direction formed inside the main header chamber 1 is formed to be smaller than a width of the flat tube 4, that is, a width of an opening of an end of the flat tube 4. In the present embodiment, the hydraulic diameter of the main header chamber 1 is set to nearly half of the width of the flat tube 4. Also, when the hydraulic diameter of the main header chamber 1 is made as small as possible, the refrigerant introduced from the refrigerant inlet port 11 may be more uniformly distributed to the uppermost portion of the main header chamber 1.

In the present embodiment, the sub header chambers 2 are formed inside sub header tubes which are joined to an outer side surface of the main header tube side by side in the vertical direction. The sub header chambers 2 are configured so that no portion of the sub header chambers 2 protrudes into the inside of the main header chamber 1. For this reason, even when the sub header chambers 2 are connected to the main header chamber 1, it is possible to prevent a vortex from occurring in the refrigerant flowing through the main header chamber 1, so that it is easy to uniformly distribute the refrigerant.

Hereinafter, in a conventional header 100A and the header 100 according to the present embodiment, the distribution state of the refrigerant in the gas-liquid mixing state to each of the plurality of sub header chambers 2 and the plurality of flat tubes 4 will be described with reference to FIG. 3A and FIG. 3B.

Figure 3A:
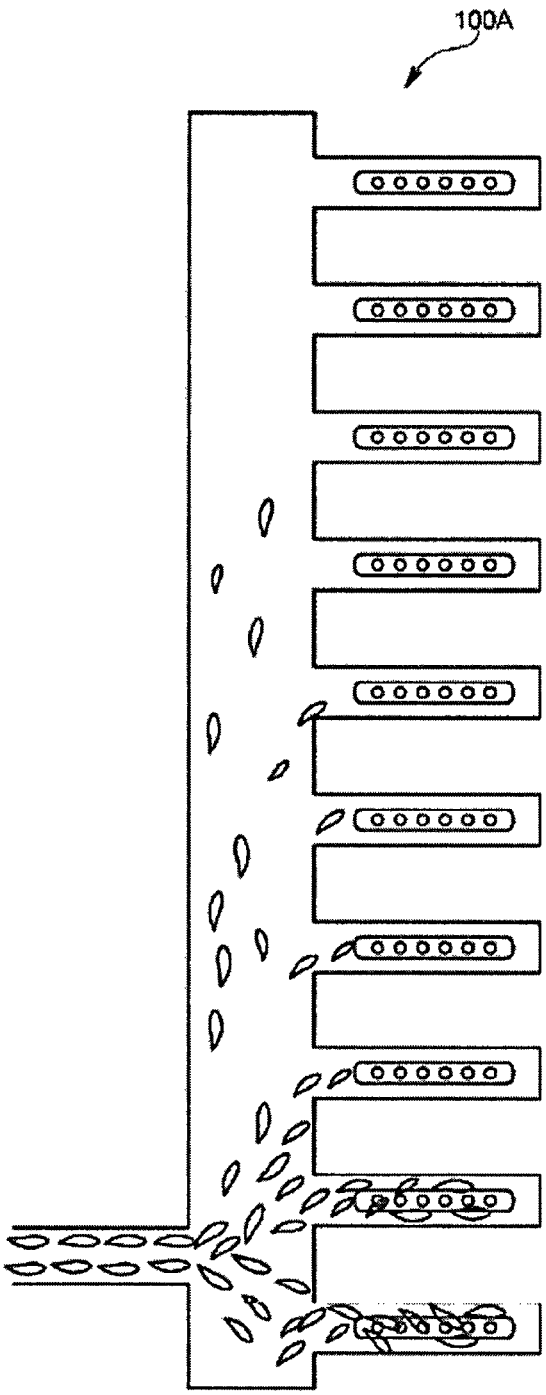
FIG. 3A PRIOR ART
FIGS. 3A and 3B are views schematically illustrating a distribution state of a refrigerant in each of a conventional header and a header according to an embodiment.

If the refrigerant outlet ports 12 connected to the sub header chambers 2 are formed at a substantially same height in the substantially horizontal direction with respect to the refrigerant inlet port 11 like the conventional header 100A, the effect of gravity is significantly influenced, so that, as illustrated in FIG. 3A, most of the refrigerant injected from the refrigerant inlet port 11 linearly flows into the sub header chambers 2 that are disposed at the lower side. As a result, in the conventional header 100A, almost no liquid refrigerant flows into sub header chambers 2 connected to the upper side of the main header chamber 1, and mainly the gas refrigerant flows into the sub header chambers 2 connected to the upper side of the main header chamber 1. Accordingly, in the conventional header 100A, the refrigerant is distributed into the plurality of flat tubes 4 with the gas-liquid mixing state uneven in the vertical direction.

Figure 3B:
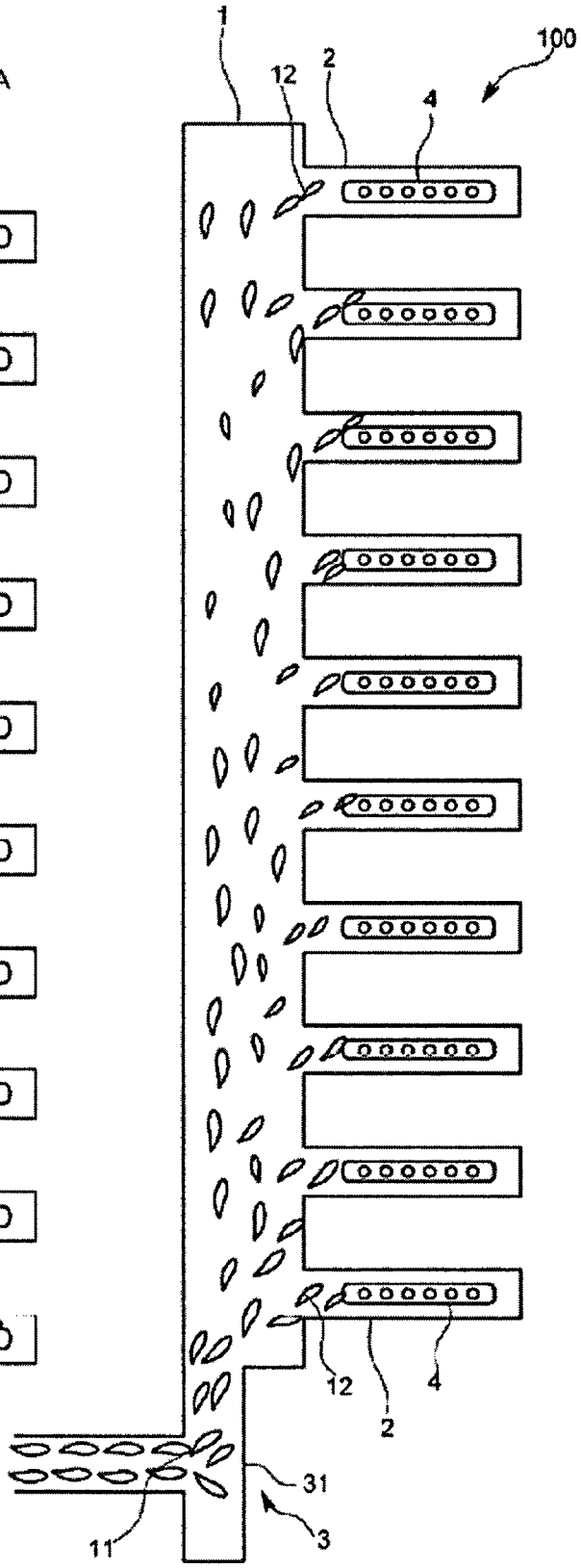

On the contrary, in the header 100 according to the present embodiment, as illustrated in FIG. 3B, the refrigerant injected from the refrigerant inlet port 11 first collides with the refrigerant collision portion 31 so that the flow of the refrigerant is changed to the upper direction of the main header chamber 1. As a result, the liquid refrigerant ingredient may reach up to the upper side of the main header chamber 1, and the refrigerant may be uniformly distributed to each of the plurality of flat tubes 4.

With the header 100 according to an embodiment as described above, because the refrigerant collision portion 31 as the flow direction changing mechanism 3 is provided to face the refrigerant inlet port 11, the flow direction of the refrigerant is changed upward so that the refrigerant in the gas-liquid mixing state can uniformly flow in the vertical direction within the main header chamber 1.

Accordingly, the refrigerant in substantially the same gas-liquid mixing state may be distributed to each of the plurality of flat tubes 4 via the plurality of sub header chambers 2 from the main header chamber 1 regardless of the vertical direction. Also, the influence of the distribution ratio according to the change of the flow rate of the refrigerant flowing into the header 100 may be reduced.

Next, the header 100 according to an embodiment will be explained.

Figure 4A:
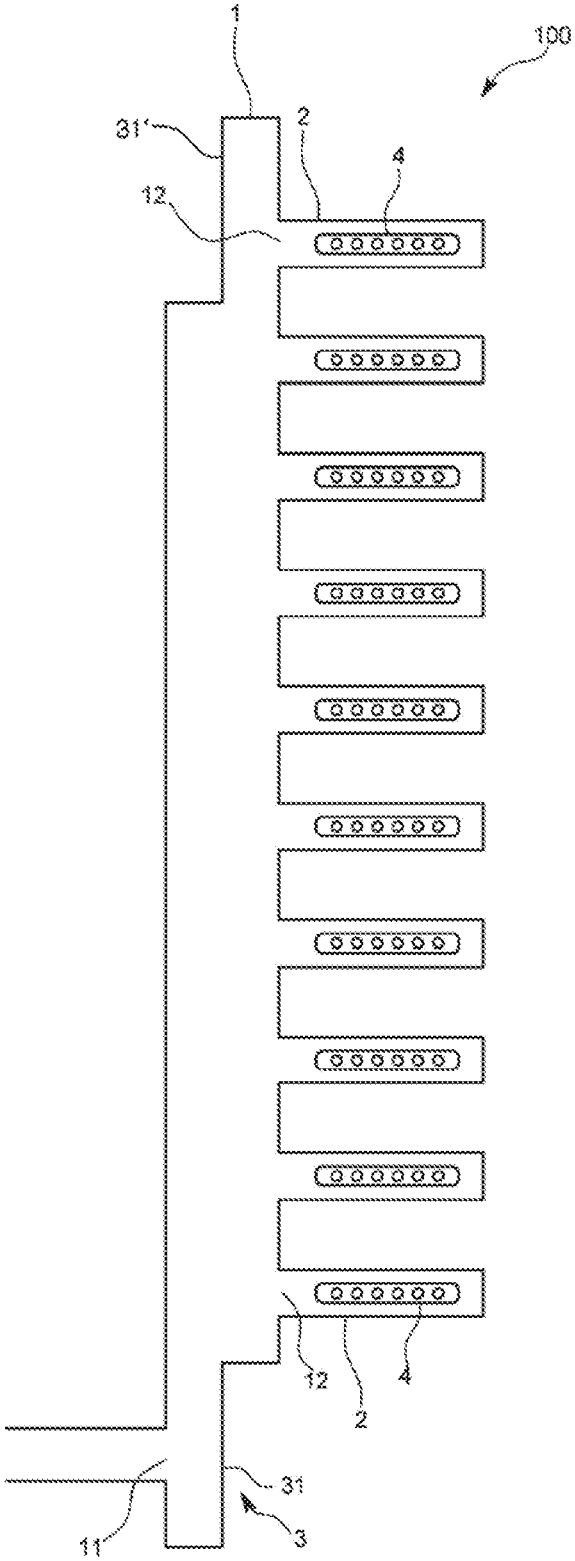
FIGS. 4A and 4B are longitudinal sectional views schematically illustrating an embodiment.
Figure 4B:
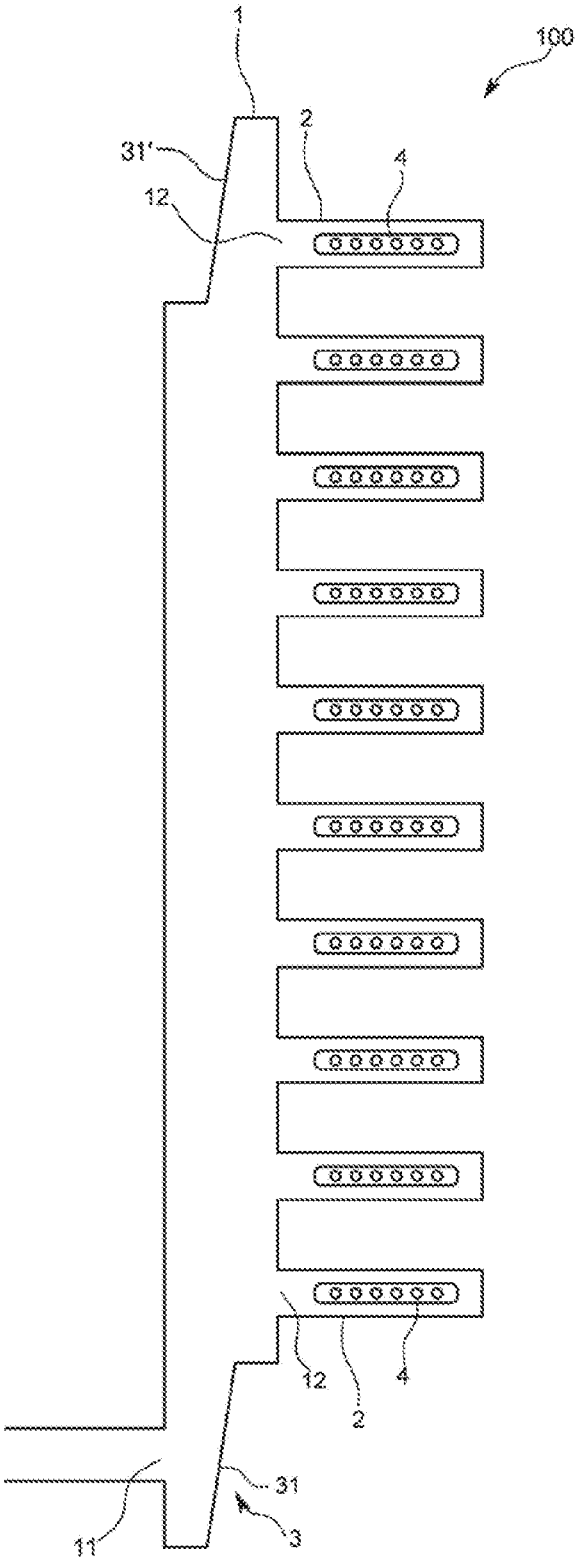

As illustrated in FIGS. 4A and 4B, a shape symmetrical to the refrigerant collision portion 31 provided in the lower end portion of the main header chamber 1 may be formed in the upper end portion of the main header chamber 1. In other words, an upper refrigerant collision portion 31' that is point symmetrical to the refrigerant collision portion 31 may be formed in the upper end portion of the main header chamber 1. At this time, the center point of the main header chamber 1 is the center of the point symmetry of the upper refrigerant collision portion 31'. In other words, the upper end portion of the main header chamber 1 may be provided with an upper flow direction changing mechanism that is point symmetrical to the flow direction changing mechanism 3.

Figure 5A:
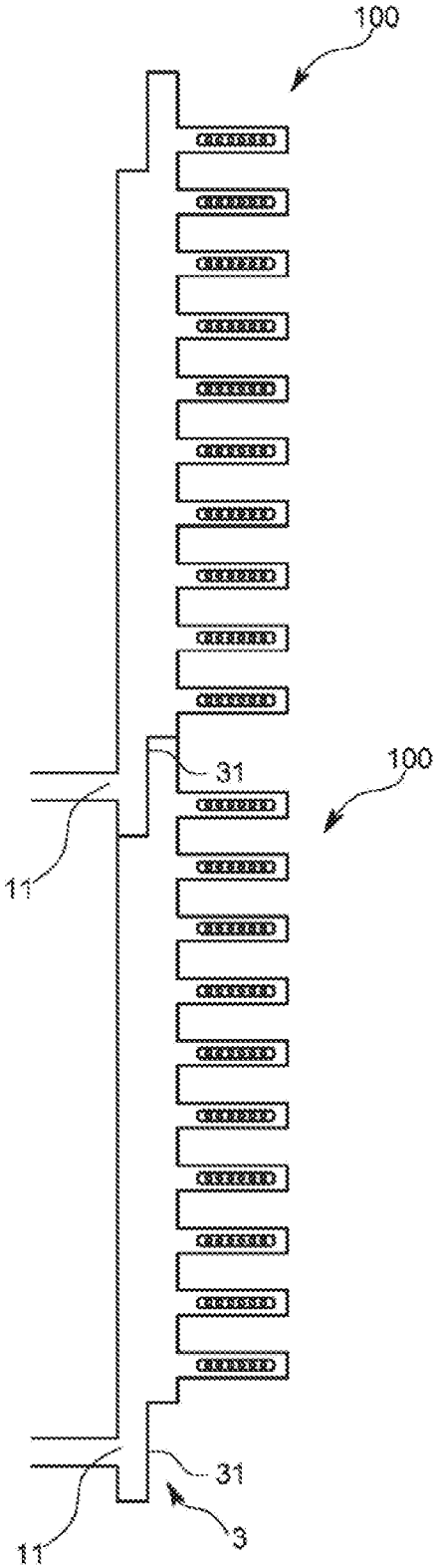
FIGS. 5A and 5B are views schematically illustrating a state in which the headers according to an embodiment are stacked in a vertical direction.
Figure 5B:
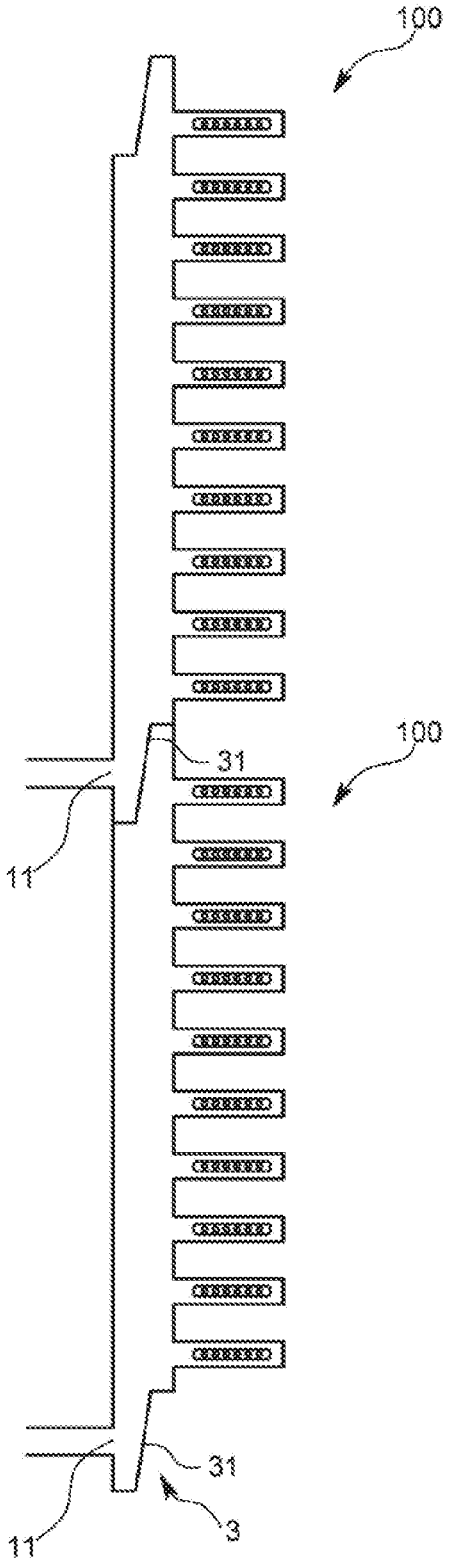

When the main header chamber 1 is formed as described above, as illustrated in FIGS. 5A and 5B, a plurality of headers 100 may be stacked in the vertical direction. Therefore, a larger and more efficient heat exchanger HE may be simply configured.

Also, the refrigerant collision portion 31 is not limited to being formed to extend straight in the axial direction of the main header chamber 1. In other words, the refrigerant collision portion 31 is not limited to being formed at a substantially right angle to the refrigerant inlet port 11 as illustrated in FIG. 4A. For example, as illustrated in FIG. 4B, the refrigerant collision portion 31 may be formed to as an inclined surface inclined from the central portion of the main header chamber 1 to the outer edge portion. In other words, the refrigerant collision portion 31 may be formed to be inclined from the center of the lower end of the main header chamber 1 toward the lowermost sub header chamber 2. Accordingly, the refrigerant collision portion 31 may be provided to form an obtuse angle with the inflow direction of the refrigerant flowing into the refrigerant inlet port 11.

Figure 6:
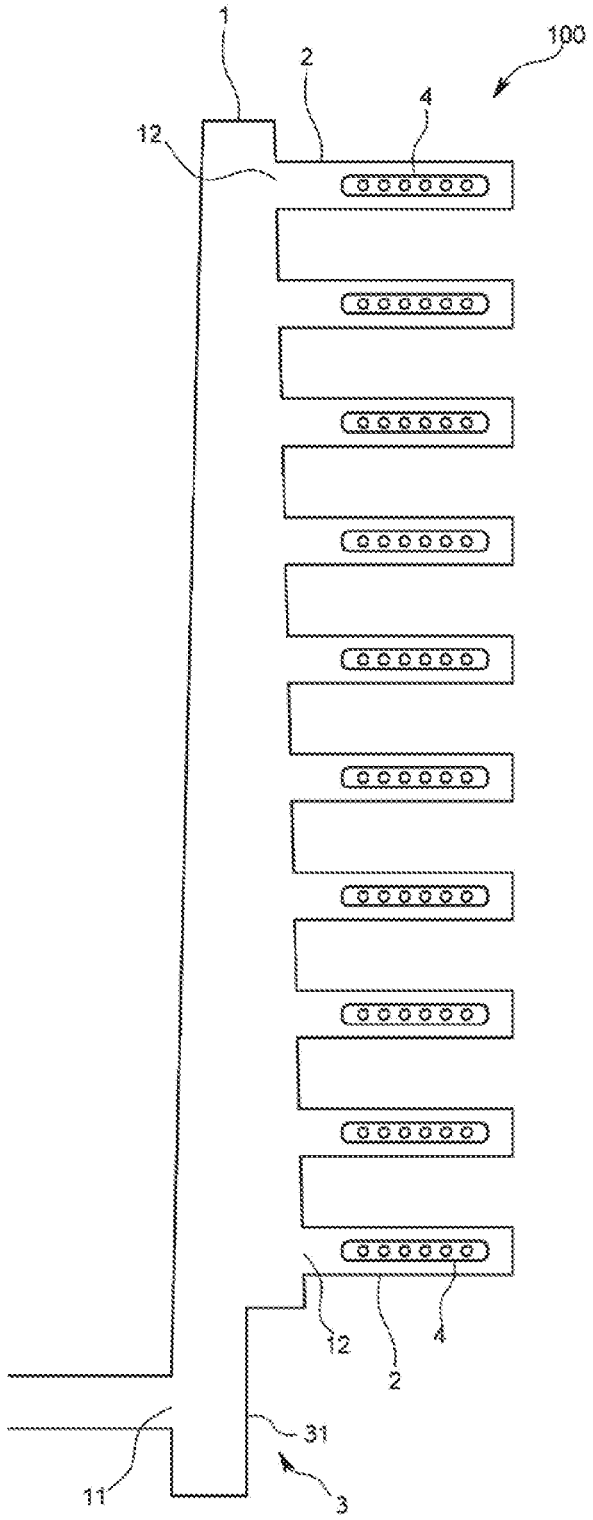
FIG. 6 is a longitudinal sectional view schematically illustrating an embodiment.

Also, the shape of the main header chamber 1 is not limited to the substantially cylindrical shape. For example, as illustrated in FIG. 6, the main header chamber 1 may be formed to have a longitudinal cross-section such as a trapezoidal shape, a triangular pyramid shape, a cone shape, etc. At this time, the width of the top end of the main header chamber 1 may be formed to be smaller than the width of the bottom end thereof.

Figure 7:
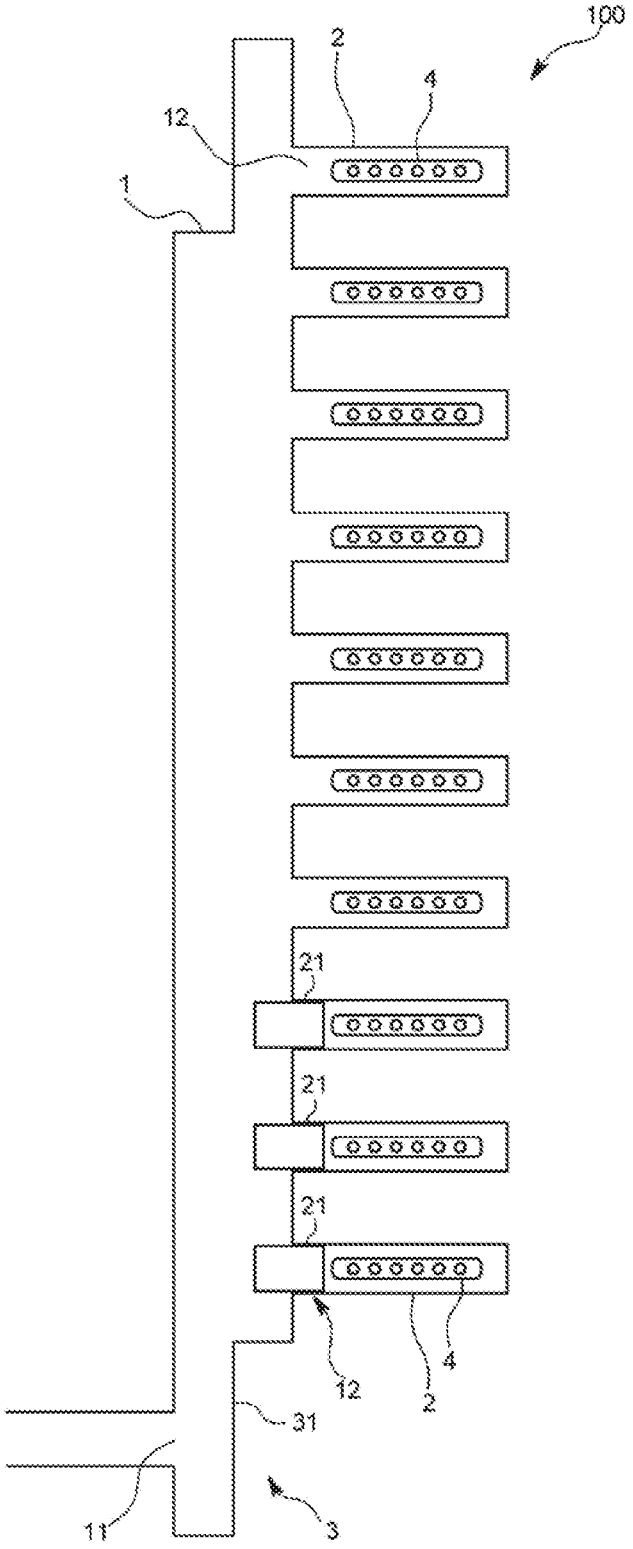
FIG. 7 is a longitudinal sectional view schematically illustrating an embodiment.

As an embodiment, as illustrated in FIG. 7, a sub-header inserting tube 21 may be disposed in the refrigerant entrance of each of the plurality of sub header chambers 2 that are provided in the lower portion of the main header chamber 1 and adjacent to the refrigerant inlet port 11. The sub-header inserting tube 21 is provided in order to reduce the hydraulic diameter of the sub header chamber 2. Accordingly, the diameter of the sub-header inserting tube 21 is smaller than the diameter of the sub header chamber 2. The sub-header inserting tube 21 is disposed so that a portion of the sub-header inserting tube 21 projects into the inner side of the main header chamber 1. With this configuration, the refrigerant is difficult to flow into the sub header chambers 2 provided in the lower portion of the main header chamber 1, and the refrigerant in the gas-liquid mixing state easily flow into the sub header chambers 2 provided in the upper portion, so that the uniform distribution of the refrigerant may be easily realized. On the other hand, FIG. 7 illustrates a case in which the sub-header inserting tubes 21 are disposed in only the three sub header chambers 2 of the lower portion of the main header chamber 1. However, the number of the sub header chambers 2 in which the sub-header inserting tube 21 is disposed is not limited thereto. For example, the sub-header inserting tube 21 may be disposed in only the lowermost sub header chamber 2.

Alternatively, the flow rate of the refrigerant flowing into each of the plurality of sub header chambers 2 may be precisely set by installing the sub-header inserting tubes 21 in all of the sub header chambers 2. For example, the inflow amount of the refrigerant flowing into each of the plurality of sub header chambers 2 may be set by making the diameters of the plurality of sub-header inserting tubes 21 gradually increase from the lower portion to the upper portion of the main header chamber 1. In other words, the inflow amount of the refrigerant flowing into each of the plurality of sub header chambers 2 may be determined by forming all of the plurality of sub-header inserting tubes 21 to be different inner diameters. Alternatively, the plurality of sub-header inserting tubes 21 may be divided into at least two groups and the inner diameter of the plurality of sub-header inserting tubes 21 of each group may be different for each group to set the inflow amount of the refrigerant flowing into each of the plurality of sub header chambers 2. At this time, the sub-header inserting tubes 21 of the group located at the upper portion of the main header chamber 1 may be formed to have an inner diameter larger than the sub-header inserting tube 21 of the group located at the lower portion of the main header chamber 1. The inner diameter of the plurality of sub-header inserting tubes 21 included in the same group may be formed to be the same. In addition, as an embodiment, without using the sub-header inserting tube 21, the inner diameters of the plurality of sub header chambers 2 may be formed to be increased sequentially from the lower portion to the upper portion of the main header chamber 1. Alternatively, the plurality of sub-header tubes 2 may be divided into at least two groups, the inner diameters of the plurality of sub-header tubes 2 of each group may be different for each group, and the inner diameters of the sub header chambers 2 in the same group may be the same to set the inflow amount of the refrigerant flowing into the plurality of sub header chambers 2.

Figure 8:
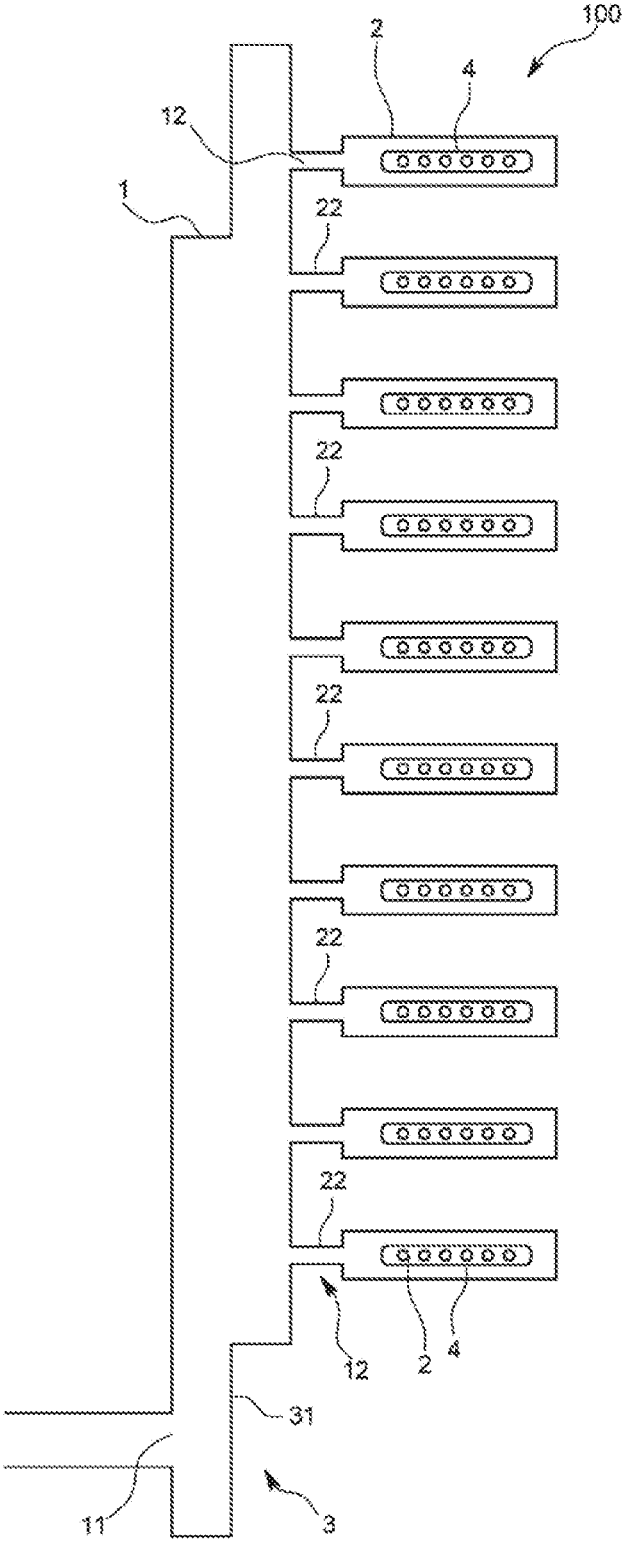
FIG. 8 is a longitudinal sectional view schematically illustrating an embodiment.

As an embodiment, as illustrated in FIG. 8, the hydraulic diameter may be reduced by forming a throttling portion 22 in a connecting portion between the main header chamber 1 and each of the plurality of sub header chambers 2. In other words, the throttling portion 22 having an inner diameter that is smaller than the inner diameter of the sub header chamber 2 may be provided between the main header chamber 1 and each of the sub header chambers 2. The distribution state of the refrigerant with respect to the plurality of sub header chambers 2 may be adjusted by adjusting the fluid resistance of each of the plurality of sub header chambers 2 by setting the inner diameters of the plurality of throttling portions 22 to be different. For example, the inflow amount of the refrigerant flowing into the plurality of sub header chambers 2 may be adjusted by making the inner diameters of the plurality of throttling portions 22 gradually increase from the lower portion to the upper portion of the main header chamber 1. Alternatively, the inflow amount of the refrigerant flowing into the plurality of sub header chambers 2 may be adjusted by dividing the plurality of throttling portions 22 into at least two groups, by making the inner diameters of the throttling portions 22 of each group gradually increase from the lower portion to the upper portion of the main header chamber 1, and by making the inner diameters of the throttling portions 22 in the same group identical.

Figure 9:
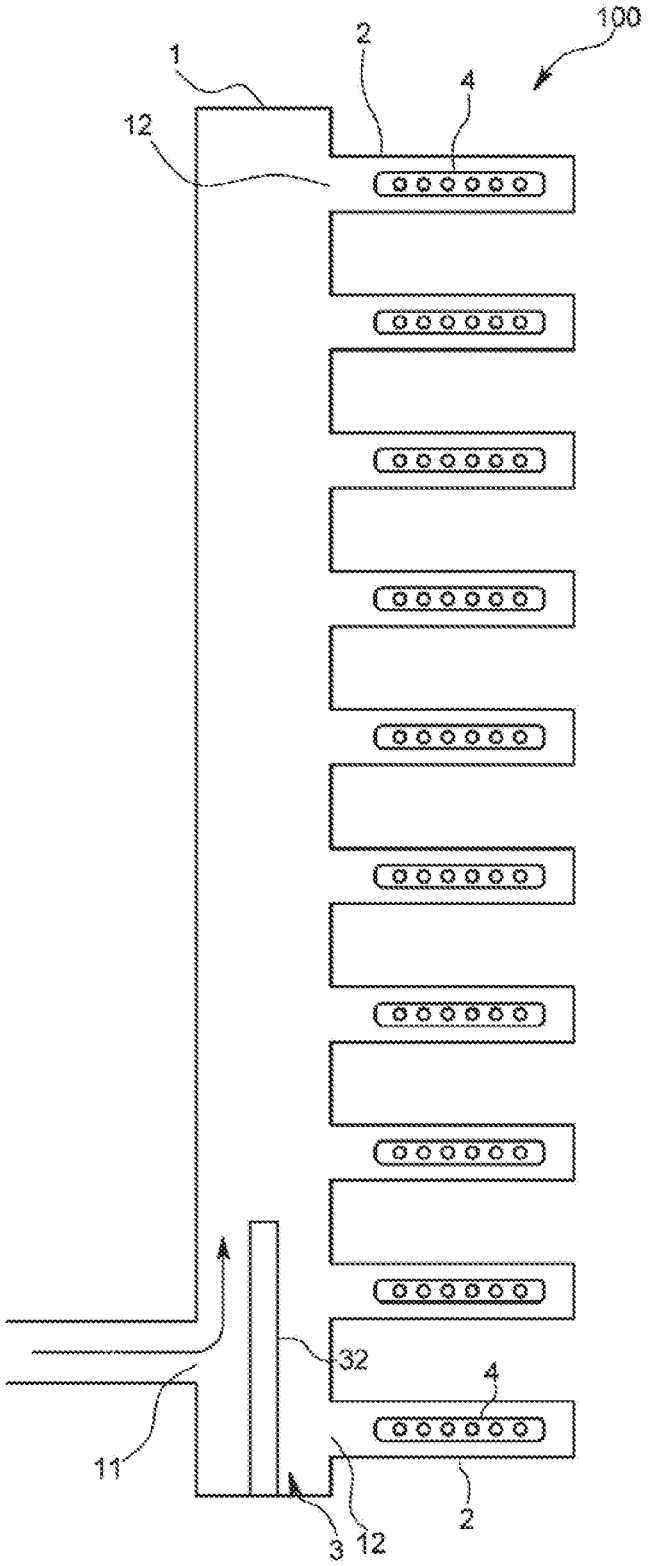
FIG. 9 is a longitudinal sectional view schematically illustrating a structure of a header according to an embodiment of the present disclosure.

As illustrated in FIG. 9, the header 100 according to an embodiment may include a resistance body 32 that extends in the vertical direction from the bottom surface of the inner side of the main header chamber 1 as the flow direction changing mechanism 3 as described above and is disposed to face the refrigerant inlet port 11 adjacent to the refrigerant inlet port 11.

The resistance body 32 may be formed in a flat plate shape, and may be provided with a number of small holes through which a part of the refrigerant can pass in the horizontal direction. At this time, the small holes may be formed in a shape such as a slit. The refrigerant injected in the horizontal direction from the refrigerant inlet port 11 of the main header chamber 1 collides with the resistance body 32, and thus its flowing direction is changed to the upward direction of the main header chamber 1.

As illustrated in FIG. 9, in the header 100 in which the refrigerant inlet port 11 is formed to face at least one sub header chamber 2, the resistance body 32 is provided between the refrigerant inlet port 11 and the at least one sub header chamber 2. Accordingly, the refrigerant ejected from the refrigerant inlet port 11 is introduced into the sub header chambers 2 through the plurality of small holes provided in the resistance body 32 without being directly introduced into the sub header chambers 2 provided behind the resistance body 32 in the lower portion of the main header chamber 1.

When the resistance body 32 is disposed on the bottom of the main header chamber 1 as described above, the refrigerant in the gas-liquid mixing state introduced into the refrigerant inlet port 11 may be distributed in the vertical direction in the inside of the main header chamber 1, thereby being uniformly dispensed to each of the plurality of flat tubes 4.

As an embodiment, the top end of the main header chamber 1 may be provided with an upper resistance body (not illustrated) that is in a point symmetry with the resistance body 32. Alternatively, in FIG. 9, the resistance body 32 is provided between the refrigerant inlet port 11 and some sub header chambers 2 provided in the lower portion among the plurality of sub header chambers 2. However, the resistance body 32 may be disposed below the lowermost sub header chamber of the plurality of sub header chambers 2. At this time, the refrigerant inlet port 11 is provided not to face the sub header chambers 2. When the resistance body 32 is provided as described above, it is not necessary to form the plurality of small holes or slots in the resistance body 32.

Figure 10A:
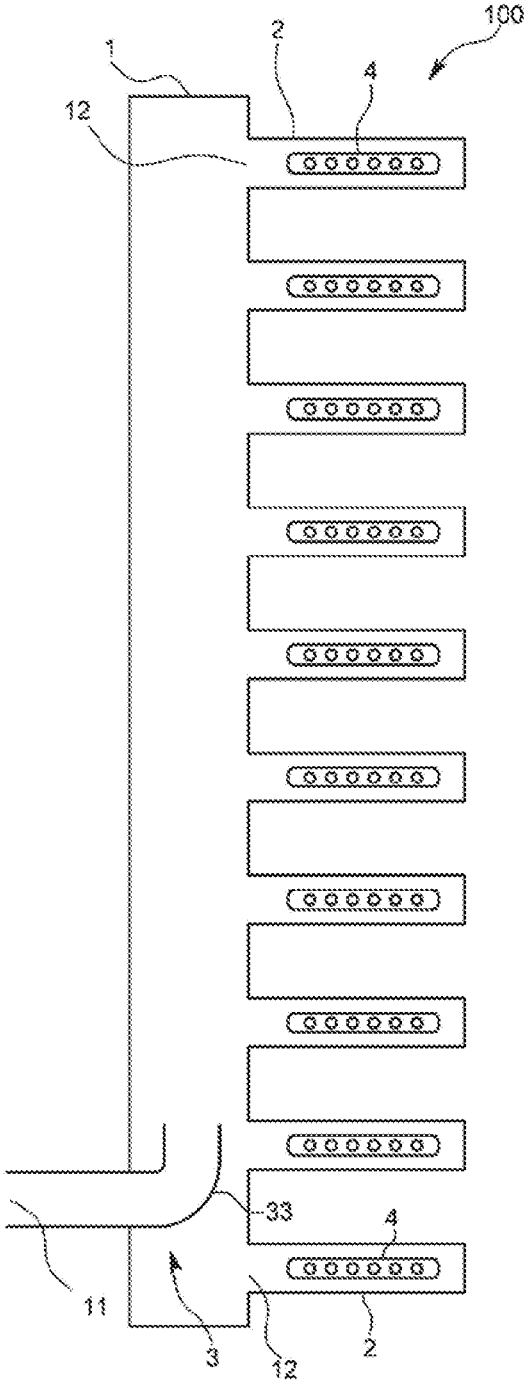
FIGS. 10A and 10B are longitudinal sectional views schematically illustrating an embodiment.
Figure 10B:
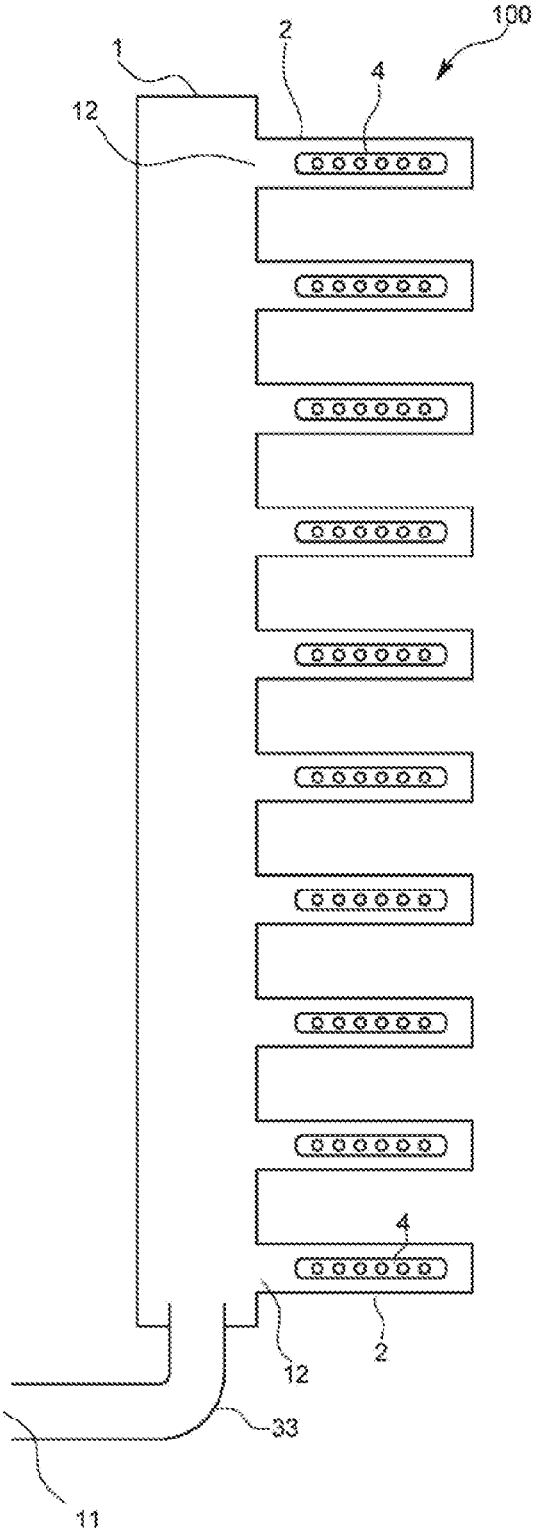

An L-shaped pipe 33 inserted into the refrigerant inlet port 11 as illustrated in FIGS. 10A and 10B may be used instead of using the above-described resistance body 32. In other words, the bent portion of the L-shaped pipe 33 may be configured to act as the flow direction changing mechanism 3 as described above. With this configuration, the refrigerant collides with the inner surface of the bent portion of the L-shaped pipe 33, and is raised in the upward direction in the inside of the main header chamber 1.

FIG. 10A illustrates a case in which the L-shaped pipe 33 is disposed in a side surface of the main header chamber 1 and the bent portion of the L-shaped pipe 33 faces at least one sub header chamber 2. In the case of FIG. 10A, a number of small holes may be formed in the bent portion of the L-shaped pipe 33 so that the refrigerant is uniformly distributed to the at least one sub header chamber 2 facing the bent portion of the L-shaped pipe 33. Accordingly, a portion of the refrigerant being discharged through the L-shaped pipe 33 may be introduced into the at least one sub header chamber 2 through the plurality of small holes of the bent portion.

FIG. 10B illustrates a case in which the L-shaped pipe 33 is disposed in the bottom of the main header chamber 1 and the bent portion of the L-shaped pipe 33 does not face the sub header chambers 2. In the case of FIG. 10B, because the bent portion of the L-shaped pipe 33 does not face the sub header chambers 2, the small holes are not formed in the bent portion of the L-shaped pipe 33.

Figure 11A:
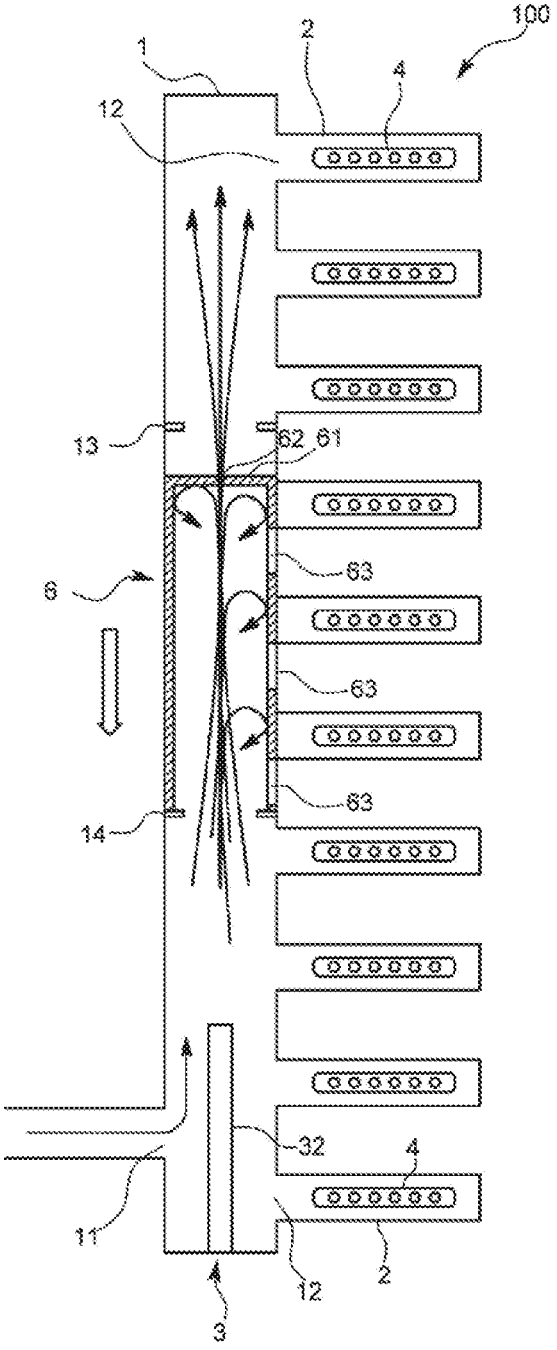
FIGS. 11A and 11B are longitudinal sectional views schematically illustrating a structure of a header according to an embodiment of the present disclosure.
Figure 11B:
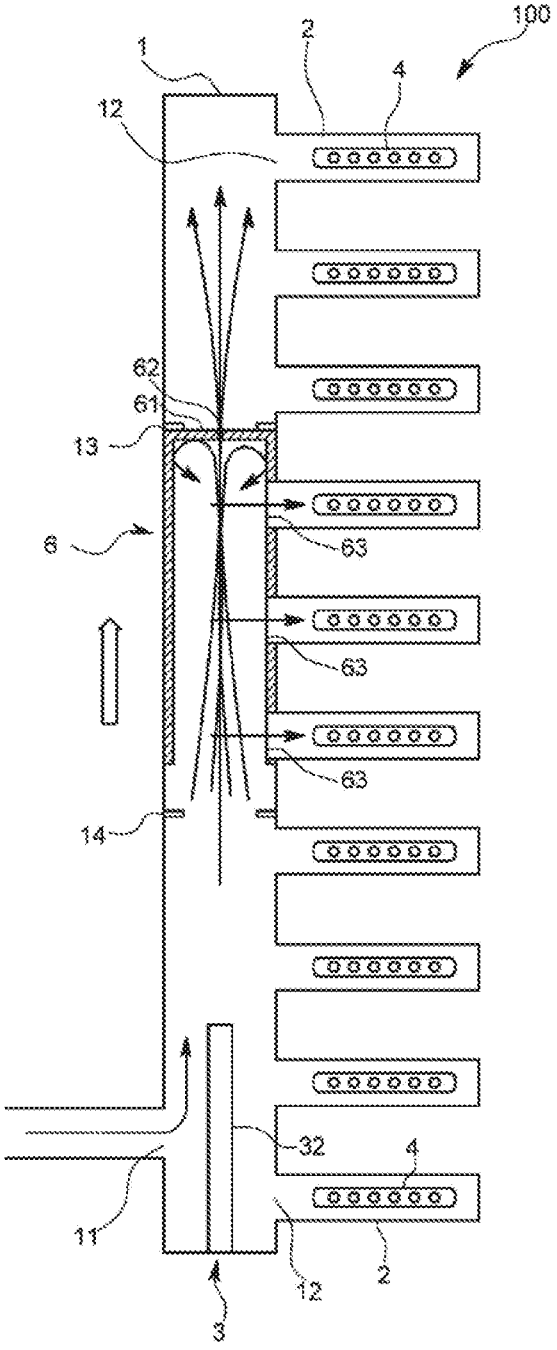
Figures 12A, 12B, 12C:
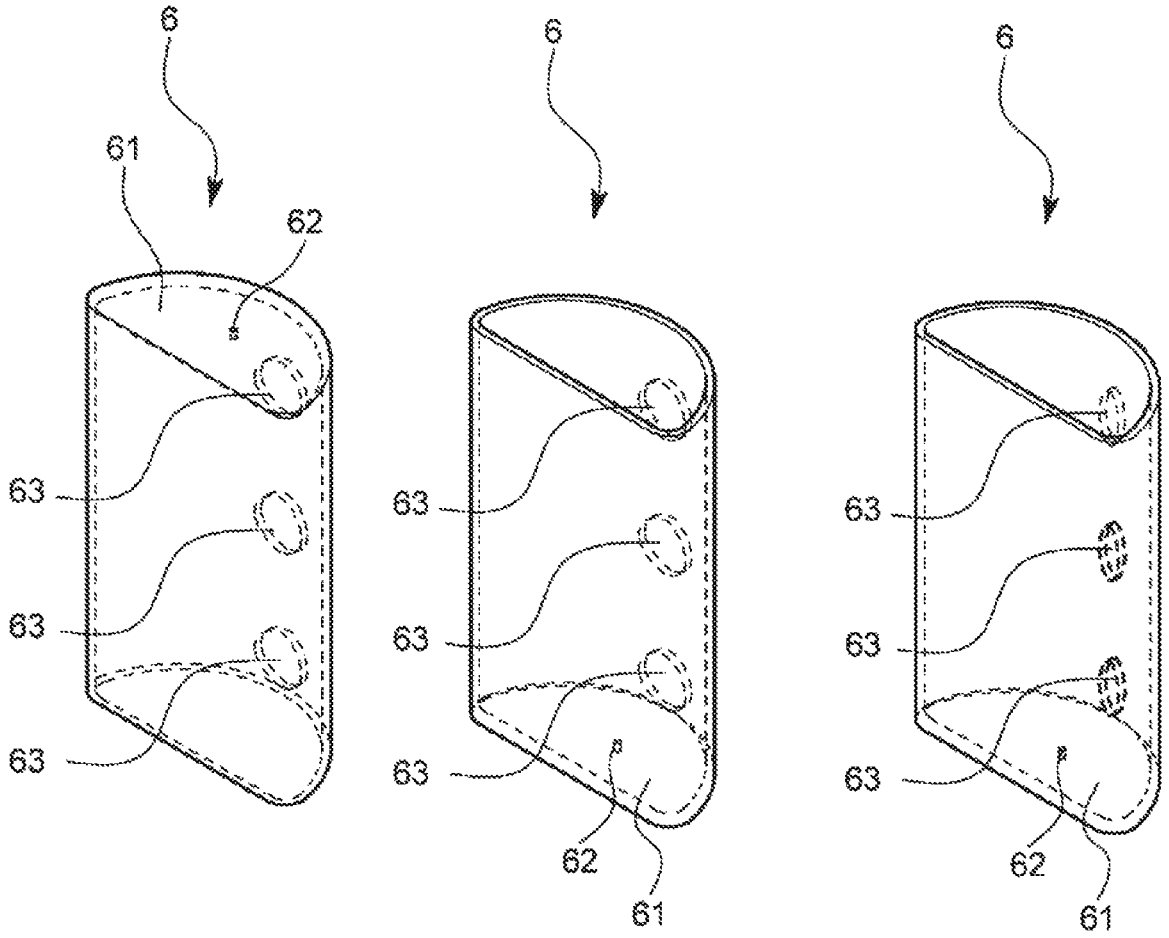
FIGS. 12A, 12B, and 12C are views schematically illustrating a structure of a tubular member of a header according to an embodiment.

The main header chamber 1 of the header 100 according to an embodiment is formed so that its cross-sectional shape is a semi-cylindrical shape as illustrated in FIGS. 11A, 11B, and 12A. Also, as illustrated in FIGS. 11A and 11B, a tubular member 6 is inserted in the main header chamber 1. The tubular member 6 has an opened end, the other end closed with a cover 61 in which a hole 62 is formed, and a side surface in which communication holes 63 capable of being in fluid communication with the refrigerant outlet port 12 are formed. The tubular member 6 is formed in substantially the semi-cylindrical shape, and is inserted into the inside of the main header chamber 1 so as to be slidably moved in the vertical direction. Accordingly, the tubular member 6 does not rotate in the circumferential direction with respect to the main header chamber 1, and the communication holes 63 and the inlets of the sub header chambers 2 are always directed in the same direction.

The inside of the main header chamber 1 is provided with an upper stopper 13 and a lower stopper 14 for restricting a moving range of the tubular member 6. The upper stopper 13 and the lower stopper 14 are provided in the inside of the main header chamber 1 so as to restrict the vertical movement distance of the tubular member 6 that is slidably disposed in the main header chamber 1.

At a position where the tubular member 6 is in contact with the lower stopper 14, as illustrated in FIG. 11A, the communication holes 63 of the tubular member 6 is not aligned with but deviated from the inlets of the sub header chambers 2. Accordingly, when the amount of the refrigerant flowing from the refrigerant inlet port 11 is small and the force of the refrigerant (the pressure of the refrigerant) is weak, it is difficult for the refrigerant to flow into the sub header chambers 2 provided in the middle portion of the main header chamber 1.

On the other hand, at a position where the tubular member 6 is in contact with the upper stopper 13, as illustrated in FIG. 11B, the communication holes 63 of the tubular member 6 are aligned with the inlets of the sub header chambers 2. In this case, a large amount of refrigerant flows into the sub header chambers 2 provided in the middle portion of the main header chamber 1.

Also, the flow direction changing mechanism 3 for changing the flow direction of the refrigerant flowing from the refrigerant inlet port 11 may be disposed on the bottom surface of the main header chamber 1. In FIGS. 11A and 11B, the resistance body 32 is provided as the flow direction changing mechanism 3. The resistance body 32 may be the same as the resistance body 32 of FIG. 9 as described above. Accordingly, the refrigerant introduced horizontally through the refrigerant inlet port 11 collides with the resistance body 32, and then is moved in the upward direction in the inside of the main header chamber 1.

Figure 13A:
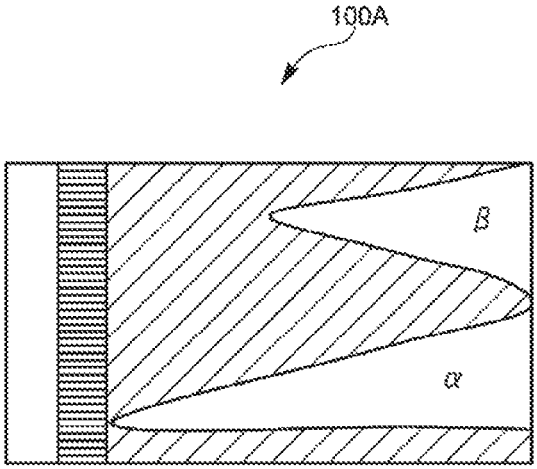
FIGS. 13A, 13B, 13C, and 13D are comparison views of overheated regions of a conventional heat exchanger and a heat exchanger according to an embodiment.
Figure 13B:
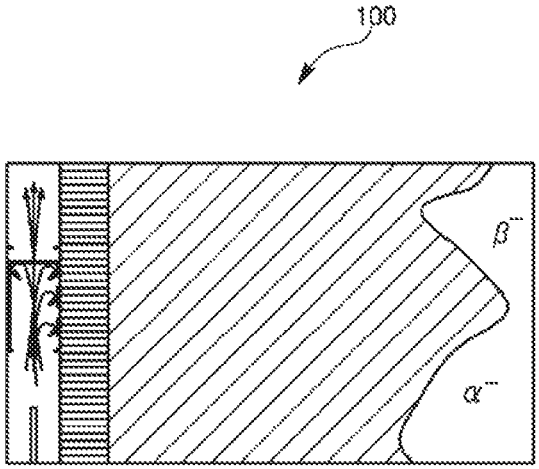

Next, effects of the header 100 according to an embodiment will be described with reference to FIGS. 13A to 13D. As illustrated in FIG. 13A, when the flow rate of the refrigerant is relatively small in the conventional header 100A, for example, over-heat regions are formed as shown in α and β of FIG. 13A, and uneven distribution occurs in the refrigerant flow. However, when the header 100 according to an embodiment is applied as illustrated in FIG. 13B, in a position where the tubular member 6 is in contact with the lower stopper 14 by its own weight, the communication holes 63 of the tubular member 6 are deviated from the flow paths of the sub header chambers 2 so that the flow of the refrigerant from the tubular member 6 into the sub header chambers 2 is restricted. Accordingly, the refrigerant flows into the α portion where the flow of the refrigerant is insufficient in the conventional header 100A of FIG. 13A, and thus the overheat region becomes smaller as in α' portion as illustrated in FIG. 13B. This is because the side surface portion between the communication holes 63 of the tubular member 6 limits the flow paths of the sub header chambers 2 in a region between the α and β portions as illustrated in FIG. 13A in which the refrigerant excessively flows in the conventional header 100A, thereby making it difficult for the refrigerant to flow. Further, the refrigerant collides with the bottom of the cover 61 of the tubular member 6 and is spattered downwardly so that the refrigerant flows in the α portion of FIG. 13A which was the conventional overheated region. Also, the refrigerant is ejected to the upper side of the tubular member 6 through the hole 62 of the cover 61 of the tubular member 6 so that the refrigerant flows in the β portion of FIG. 13A which was the conventional overheated region. As a result, the overheated region is reduced as β' portion as illustrated in FIG. 13B.

Figure 13C:
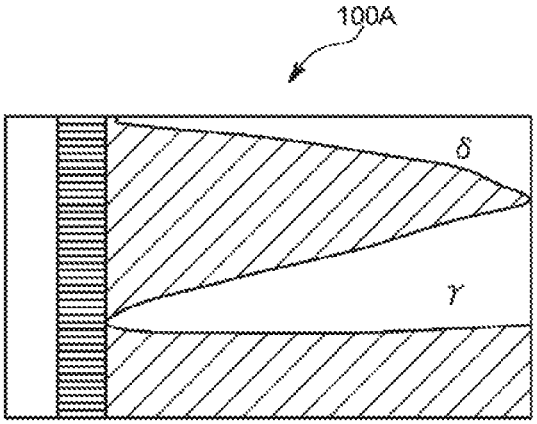
Figure 13D:
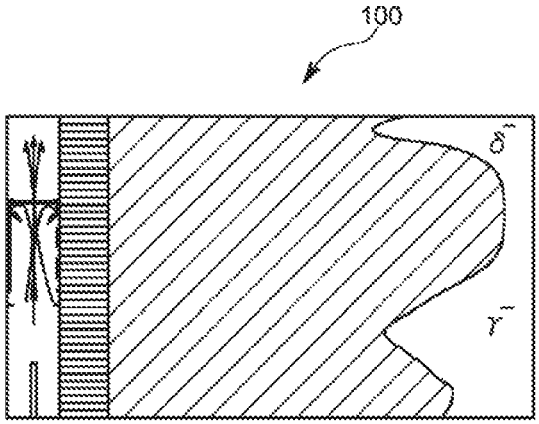

On the other hand, in the conventional header 100A, when the flow rate of the refrigerant is relatively large, for example, overheated regions are formed as in γ and δ of FIG. 13C, and uneven distribution of the refrigerant flow is different from when the flow rate of the refrigerant is relatively small as described above, and the refrigerant generally tends to flow more upward. Thereby, the tubular member 6 performs an operation opposite to that of FIG. 13B, so that the communication holes 63 of the tubular member 6 may be aligned with the flow paths of the sub header chambers 2 as illustrated in FIG. 13D. Accordingly, the refrigerant flows in the parts which were the conventional overheated regions without any resistance, and, the refrigerant collides with the bottom of the cover 61 of the tubular member 6 and is spattered downwardly so that the refrigerant flow into the sub header chambers 2 is promoted. As a result, the γ portion of FIG. 13C which was the conventional overheated region becomes narrow as shown in γ' portion of FIG. 13D. Further, because the refrigerant is ejected to the conventional uppermost overheated region above the tubular member 6 through the hole 62 of the cover 61 of the tubular member 6, the δ portion of FIG. 13C which was the conventional overheated region is reduced as δ' portion of FIG. 13D.

The header 100 according to an embodiment as described above may achieve a uniform heat exchange in the entire heat exchanger by reducing the overheated regions, thereby improving the efficiency of the heat exchanger.

A header 100 according to an embodiment may be configured so that in a position where the tubular member 6 is in contact with the lower stopper 14, the communication holes 63 of the tubular member 6 is aligned with the sub header chambers 2, and in a position where the tubular member 6 is in contact with the upper stopper 13, the communication holes 63 of the tubular member 6 is offset from the sub header chambers 2. The inlets of the sub header chambers 2 may not be fully covered by the outer surface of the tubular member 6, and an area of the communication hole 63 that is in fluid communication with the inlet of the sub header chamber 2 is changed by the movement of the tubular member 6 in the vertical direction.

As an embodiment, as illustrated in FIG. 12B, the cover 61 may be formed to cover the bottom end of the tubular member 6. Also, the shape of the communication hole 63 of the tubular member 6 may be matched to the shape of the refrigerant outlet port 12. Alternatively, as illustrated in FIG. 12C, the communication hole 63 may be formed in an oval shape, thereby appropriately changing the communicating area.

Figure 14:
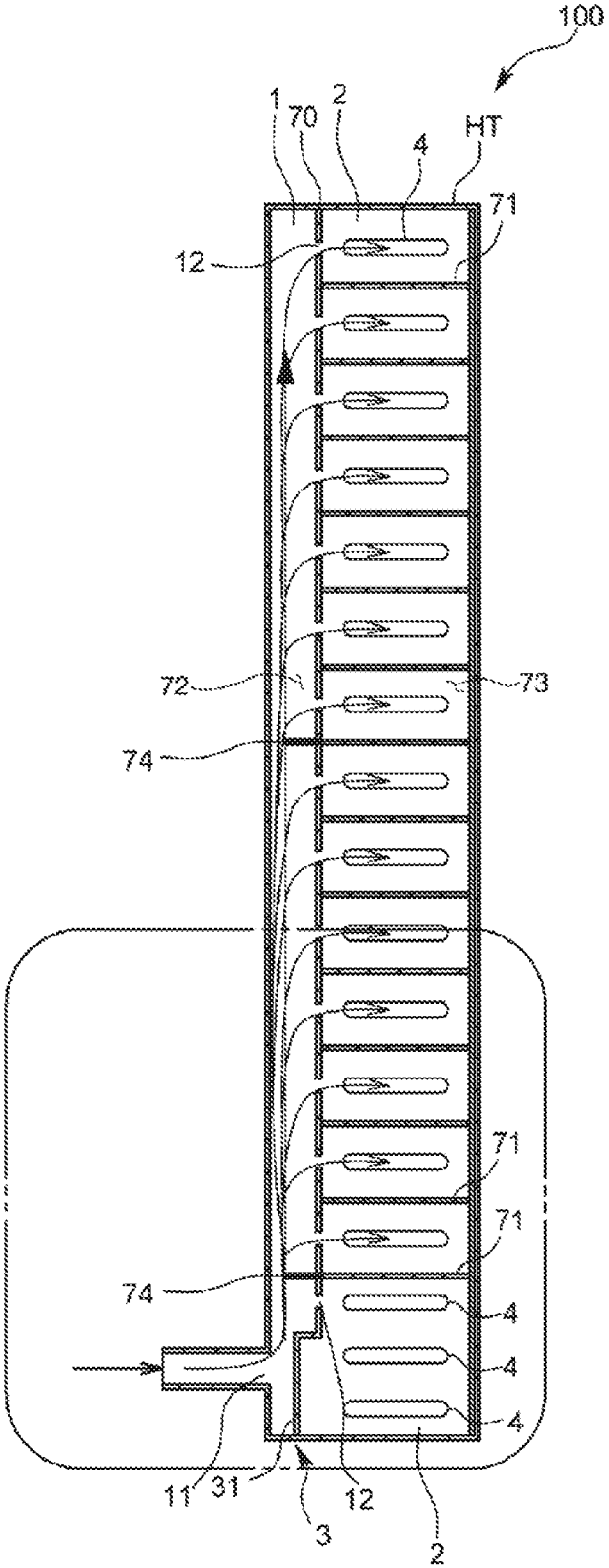
FIG. 14 is a longitudinal sectional view schematically illustrating a structure of a header according to an embodiment of the present disclosure.

A header 100 according to an embodiment of the present disclosure, as illustrated in FIG. 14, forms a main header chamber 1 and a plurality of sub header chambers 2 by partitioning the inside of one header tube HT into a plurality of spaces in a vertical direction and a horizontal direction by using sheet materials. In detail, a vertical space (a first space) that is defined by a first plate member 70, which has a flat plate shape and extends in the vertical direction inside the header tube HT, and is provided with a refrigerant inlet port 11 serves as the main header chamber 1. On the other hand, a plurality of spaces (second spaces) formed by horizontally partitioning one of the both spaces partitioned by the first plate member 70 inside the header tube HT, which is provided with holes into which flat tubes 4 are inserted, by using a plurality of second plate members 71 arranged in parallel in the vertical direction serve as a plurality of sub header chambers 2.

The refrigerant inlet port 11 is provided on a lower side surface of the main header chamber 1, and the flow direction changing mechanism 3 is constituted by a portion of the first plate member 70 extending in the vertical direction from the bottom surface inside the main header chamber 1. Further, the refrigerant inlet port 11 is provided below any one of the plurality of refrigerant outlet ports 12 in fluid communication with the sub header chambers 2, and the flow direction changing mechanism 3 for changing the flow of the refrigerant from the horizontal direction to the upward direction is formed in the direction in which the refrigerant is ejected from the refrigerant inlet port 11. In the header 100 according to an embodiment, the flow direction changing mechanism 3 is a refrigerant collision portion 31 formed as a portion of the first plate member 70 facing the refrigerant inlet port 11 in the header tube HT.

In the header 100 according to an embodiment, the hydraulic diameter of the main header chamber 1 is determined to approximately half of the width dimension of the flat tube 4. Further, making the hydraulic diameter of the main header chamber 1 as small as possible makes it easier to more evenly distribute the refrigerant introduced from the refrigerant inlet port 11 to the top portion of the first space 72.

The sub header chambers 2 are provided not to project into the main header chamber 1, thereby preventing vortexes from occurring in the communication portions between the first space 72 and the second spaces 73 so that uniform distribution of the refrigerant may be facilitated.

At least a part of the main header chamber 1 is provided with a plurality of throttling plates 74 for partitioning the main header chamber 1 in the vertical direction and narrowing the flow path. As another example, only one throttling plate 74 may be provided. The throttling plates 74 are provided to project in the horizontal direction from the first plate member 70 into the inside of the main header chamber 1, and partition a space between the refrigerant inlet port 11 disposed in the lower portion and some of the plurality of refrigerant outlet ports 12.

The sub header chamber 2 located at the lowest position is partitioned so as to be in fluid communication with the three flat tubes 4, and the sub header chambers 2 other than the lowermost sub header chamber 2 are formed to be in fluid communication with one flat tube 4. In the header 100 as illustrated in FIG. 14, the lowermost sub header chamber 2 is connected with three flat tubes 4; however, the number of the flat tubes 4 connected to the lowermost sub header chambers 2 is not limited thereto. One or more flat tubes 4 may be connected to the lowermost sub header chamber 2.

With the header 100 according to an embodiment of the present disclosure having the above-described structure, the refrigerant collision portion 31 as the flow direction changing mechanism 3 is provided to face the refrigerant inlet port 11, thereby making the flow direction of the refrigerant upward, so that the refrigerant in the gas-liquid mixing state may be uniformly distributed in the up-and-down direction inside the main header chamber 1. Further, when the throttling plates 74 are provided inside the main header chamber 1, the refrigerant flowing upward may be more evenly distributed to the refrigerant outlet ports 12.

Figure 15:
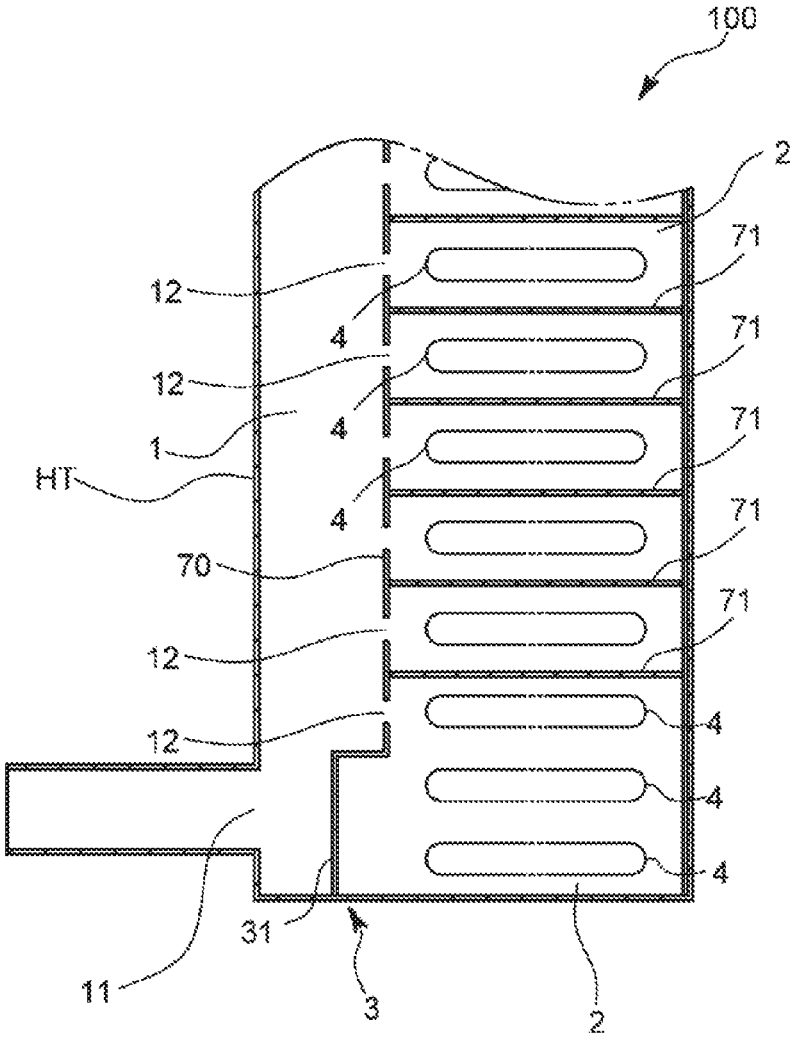
FIG. 15 is an expanded longitudinal sectional view schematically illustrating a lower portion of a header according to an embodiment.

Also, as illustrated in FIG. 15 in which the lower portion of the header 100 of FIG. 14 is enlarged, a plurality of flat tubes 4 are connected to the header tube HT in the lowermost sub header chamber 2 adjacent to the refrigerant collision portion 31. Accordingly, it is possible to reduce the amount of the refrigerant to be distributed to one flat tube 4 as compared with other sub header chambers 2. Therefore, the substantially same amount of refrigerant as the other flat tubes 4 may be distributed to the flat tubes 4 disposed at a portion where the refrigerant can be most easily introduced from the refrigerant inlet port 11.

Figure 16:
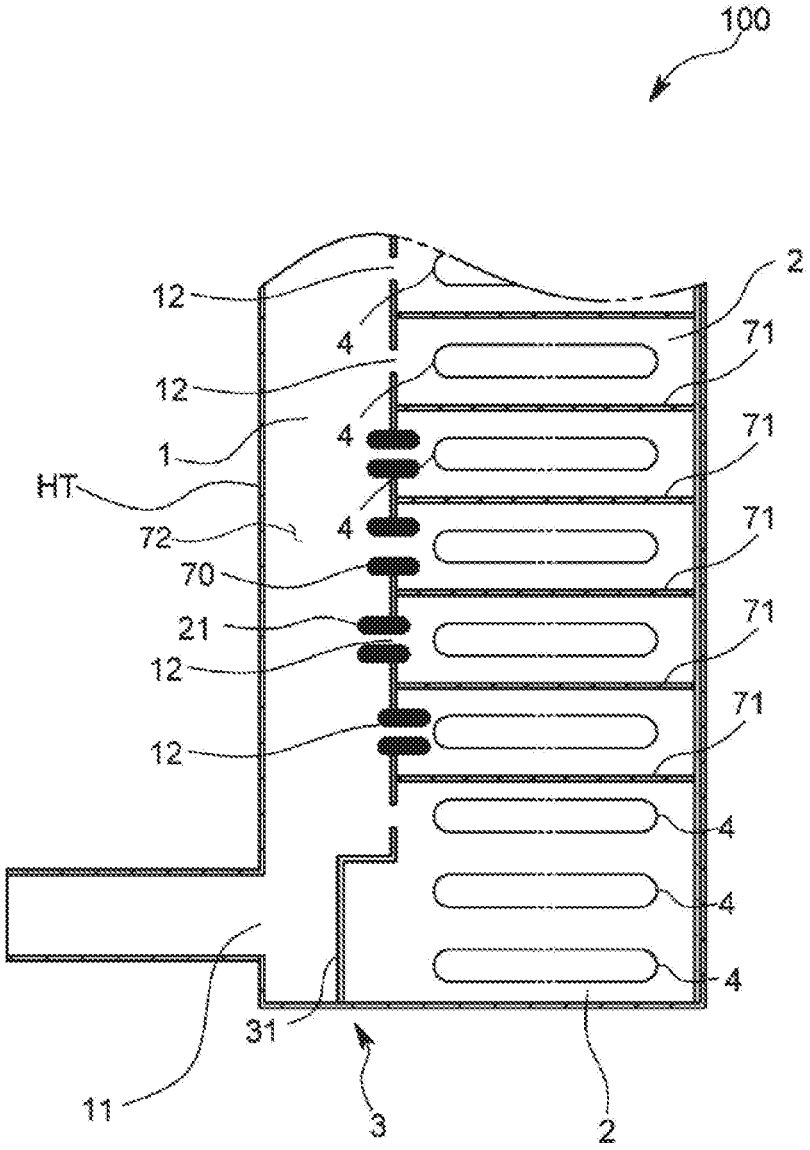
FIG. 16 is an expanded longitudinal sectional view schematically illustrating a lower portion of a header according to an embodiment.

As illustrated in FIG. 16, at least one sub header inserting tube 21 may be added to the refrigerant outlet ports 12. The distribution of the refrigerant to the sub header chambers 2 may be controlled by using the at least one sub-header inserting tube 21. Alternatively, the distribution of the refrigerant to the sub header chambers 2 may be controlled by projecting the sub-header inserting tube 21 into the first space 72 to generate vortexes in the flow of the refrigerant. At this time, the amount of the refrigerant introduced into the sub header chambers 2 may be adjusted by appropriately changing a protruding length of each of the plurality of sub-header inserting tube 21 inserted into the plurality of sub header chambers 2 which protrude into the first space 72 and an inner diameter of each of the sub-header inserting tubes 21, that is, the diameter of each of the refrigerant outlet ports 12.

Figure 17:
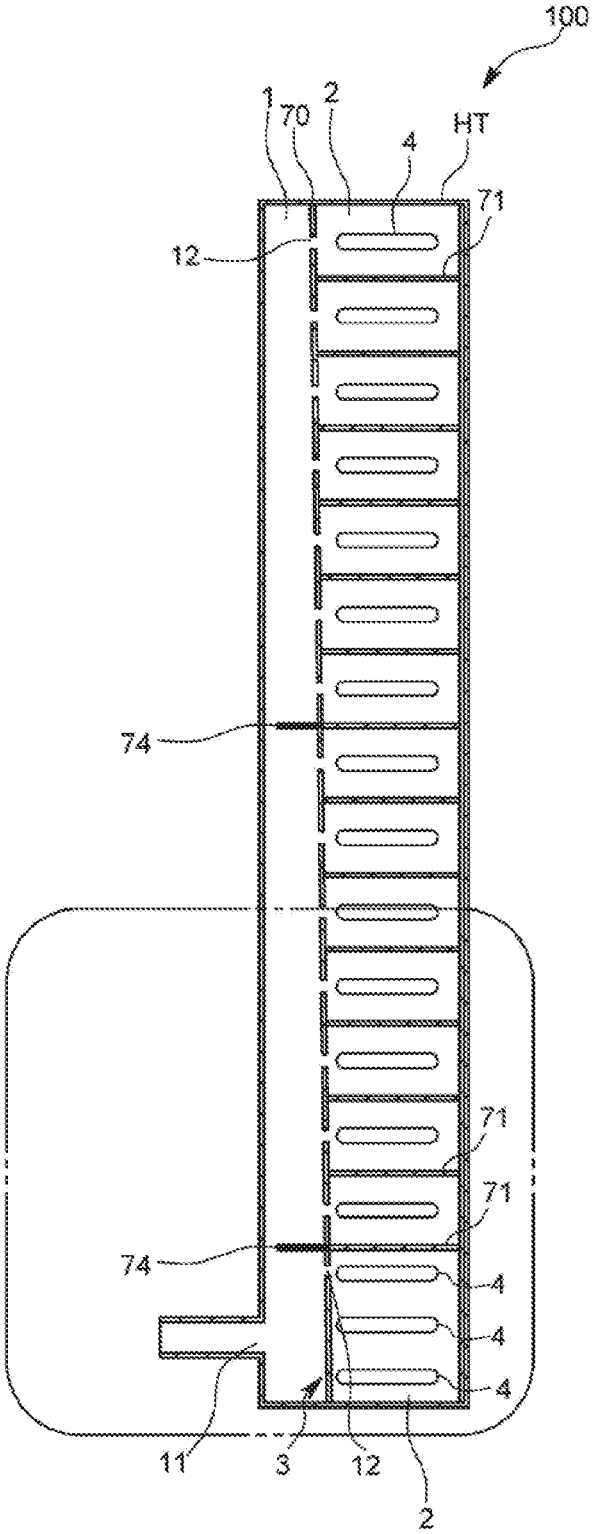
FIG. 17 is a longitudinal sectional view schematically illustrating a header according to an embodiment.

The first plate member 70 is not limited to the one extending straight in the axial direction of the header tube HT. For example, as illustrated in FIG. 17, the first plate member 70 may be formed in an inclined surface inclined from the center to the outer edge in the radial direction as it goes from the upper portion to the lower portion of the header tube HT. In other words, the first plate member 70 may be provided with an inclined surface inclined downward so that a width of the top end of the main header chamber 1 is smaller than a width of the bottom end of the main header chamber 1.

Figure 18:
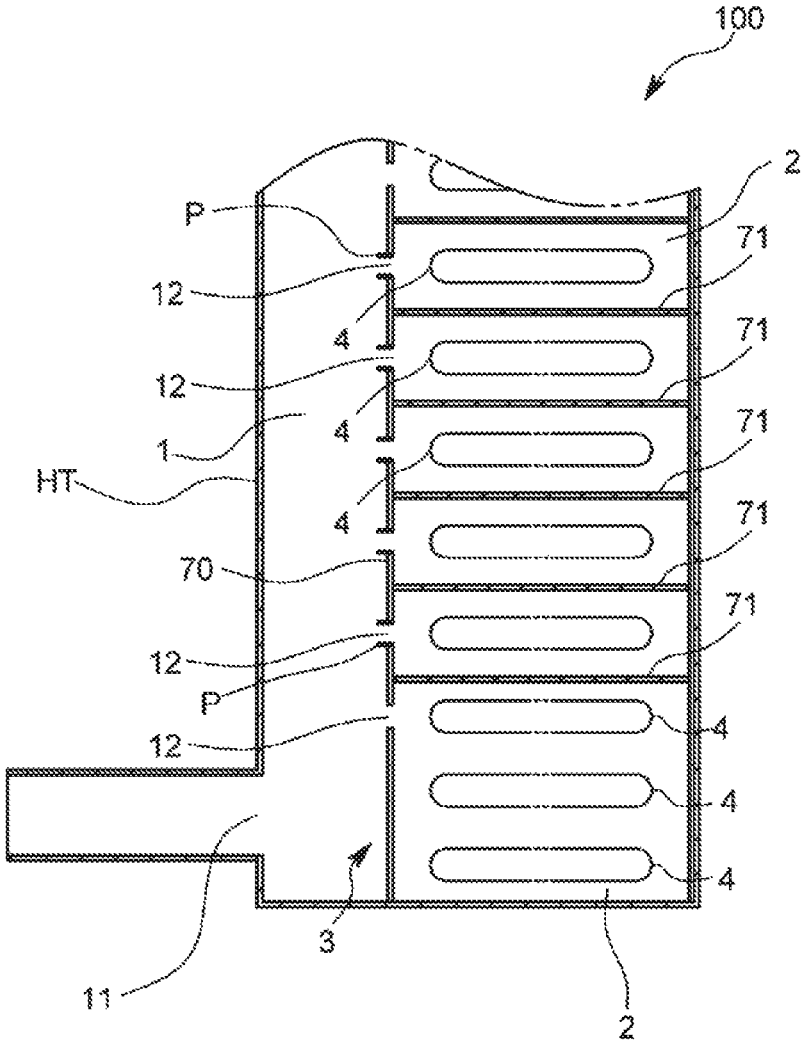
FIG. 18 is an expanded longitudinal sectional view schematically illustrating a lower portion of a header according to an embodiment.

Also, as illustrated in FIG. 18, a plurality of micro projections P protruding from the refrigerant outlet ports 12 into the main header chamber 1 may be formed in a plurality of refrigerant outlet ports 12 provided in the lower portion of the header tube HT adjacent to the refrigerant inlet port 11. At this time, the micro projections P may be formed by burring the first plate member 70. At this time, by varying the diameter of the burring hole and the height of the burring, that is, the diameter and height of each of the plurality of micro projections P, the fluid resistance of the sub header chambers 2 may be adjusted so that the distribution state of the refrigerant is adjusted.

Further, the inflow amount of the refrigerant flowing into each sub header chambers 2 may be finely set by providing the above-described micro projections P in all the sub header chambers 2. For example, the inflow amount of the refrigerant flowing into each of the plurality of sub header chambers 2 may be set by making the diameters of the plurality of micro projections P gradually increase from the lower portion to the upper portion of the main header chamber 1. In other words, the diameters of the plurality of micro projections P may be formed differently so that the inflow amount of the refrigerant flowing into each of the plurality of sub header chambers 2 may be determined. Alternatively, the plurality of micro projections P may be divided into at least two groups, the diameters of the plurality of micro projections P of each group may be different by each group to set the inflow amount of the refrigerant flowing into the plurality of sub header chambers 2. At this time, the diameters of the micro projections P of a group located at the upper portion of the main header chamber 1 may be larger than the diameters of the micro projections P of a group located at the lower portion thereof, and the diameters of the plurality of micro projections P included in the same group may be the same.

Figure 19:
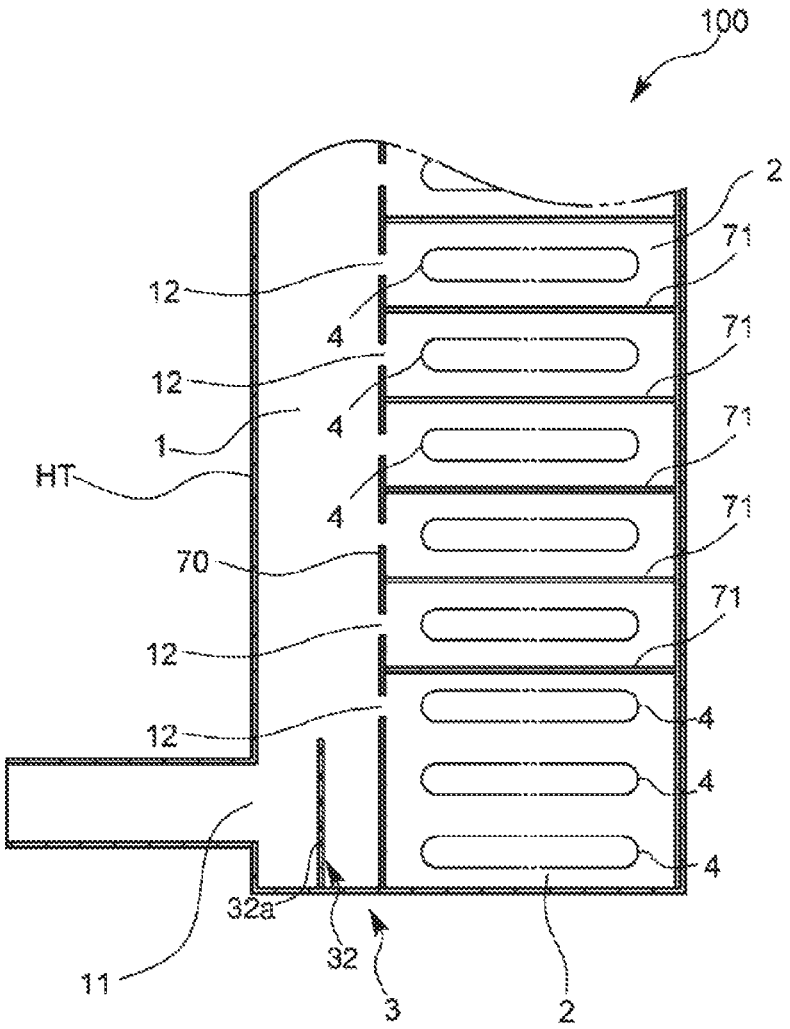
FIG. 19 is an expanded longitudinal sectional view schematically illustrating a lower portion of a header according to an embodiment.

As illustrated in FIG. 19, in the header 100 according to an embodiment, as the flow direction changing mechanism 3 as described above, a resistance body 32 may be provided to extend in the vertical direction from the bottom in the inside of the header tube HT, and to face the refrigerant inlet port 11 adjacent to the refrigerant inlet port 11.

The resistance body 32 may be provided with a plurality of small holes 32*a* for allowing some of the refrigerant to pass in the horizontal direction. As another example, the small hole may be formed in a slit or the like. The refrigerant ejected in the horizontal direction from the refrigerant inlet port 11 collides with the resistance body 32, so that the flow direction of the refrigerant may be changed to the upward direction of the header tube HT.

When the header 100 is formed as described above, the refrigerant in the gas-liquid mixing state may be distributed in the vertical direction inside the main header chamber 1, thereby being uniformly distributed to each of the plurality of flat tubes 4.

Figure 20:
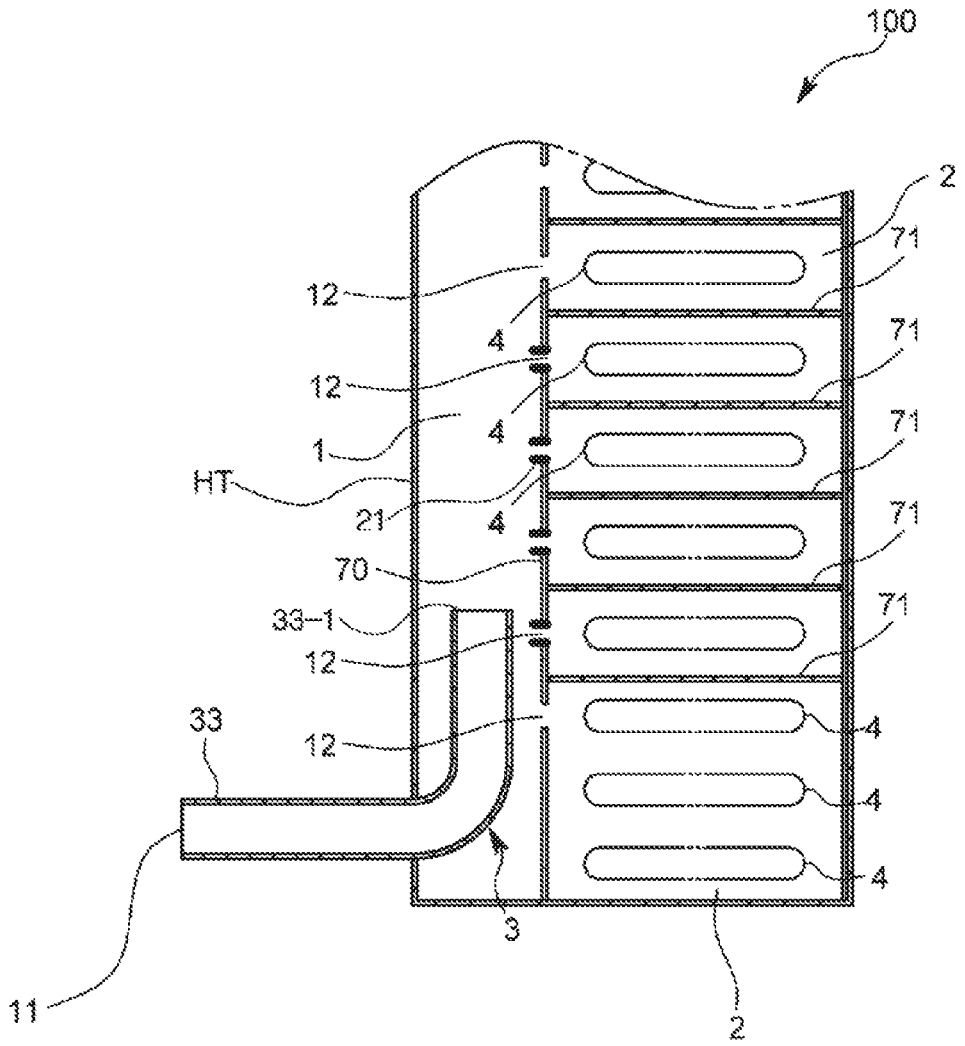
FIG. 20 is an expanded longitudinal sectional view schematically illustrating a lower portion of a header according to an embodiment.
Figure 21:
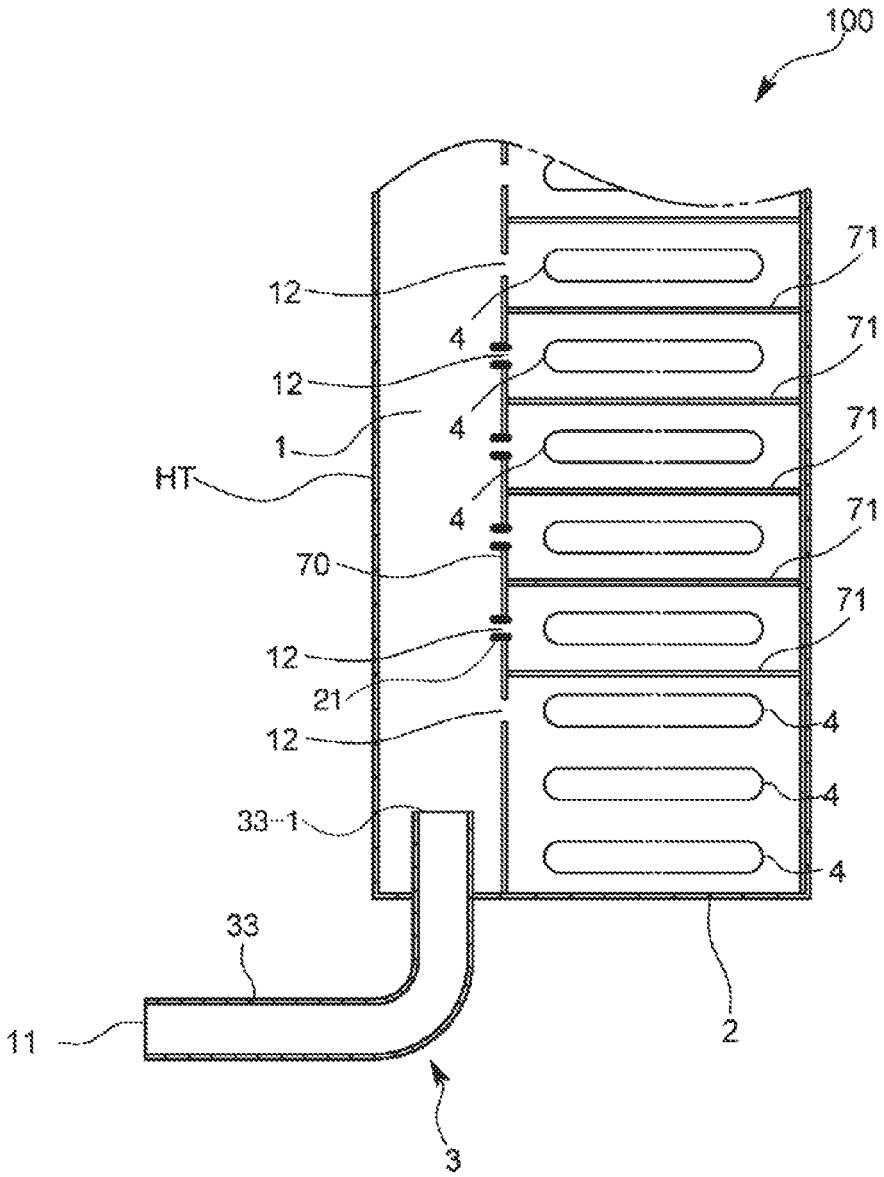
FIG. 21 is an expanded longitudinal sectional view schematically illustrating a lower portion of a header according to an embodiment.

Instead of using the above-described resistance body 32, a L-shaped pipe 33 inserted into the refrigerant inlet port 11 as illustrated in FIGS. 20 and 21 may be used. In other words, the bent portion of the L-shaped pipe 33 acts as the flow direction changing mechanism 3, so that the refrigerant that has collided against the inner surface of the L-shaped pipe 33 is raised in the upward direction of the header tube HT.

FIG. 20 illustrates a case where the L-shaped pipe 33 is provided at a lower portion of one side surface of the main header chamber 1 so that the bent portion of the L-shaped pipe 33 faces at least one sub header chamber 2. In other words, the top end 33-1 of the L-shaped pipe 33 is positioned higher than the lowermost sub header chamber 2. In the case of FIG. 20, a plurality of small holes may be formed in the bent portion of the L-shaped pipe 33 so that the refrigerant may be uniformly distributed to the at least one sub header chamber 2 facing the bent portion of the L-shaped pipe 33. Accordingly, some of the refrigerant discharged through the L-shaped pipe 33 may flow into the at least one sub header chamber 2 through the plurality of small holes of the bent portion.

FIG. 21 illustrates a case where the L-shaped pipe 33 is provided at the bottom of the main header chamber 1 so that the bent portion of the L-shaped pipe 33 does not face the refrigerant outlet ports 12. In other words, the top end 33-1 of the L-shaped pipe 33 is positioned lower than the lowermost refrigerant outlet port 12. In the case of FIG. 21, because the bent portion of the L-shaped pipe 33 and the sub header chambers 2 do not face each other, the small hole is not provided in the bent portion of the L-shaped pipe 33.

Hereinafter, a method for manufacturing a header according to an embodiment of the present disclosure will be described.

The header 100 according to an embodiment of the present disclosure as described above may be manufactured by using parts molded by a press, by using extrusion-molded parts, or by combining press-molded parts and extrusion-molded parts.

Figure 22:
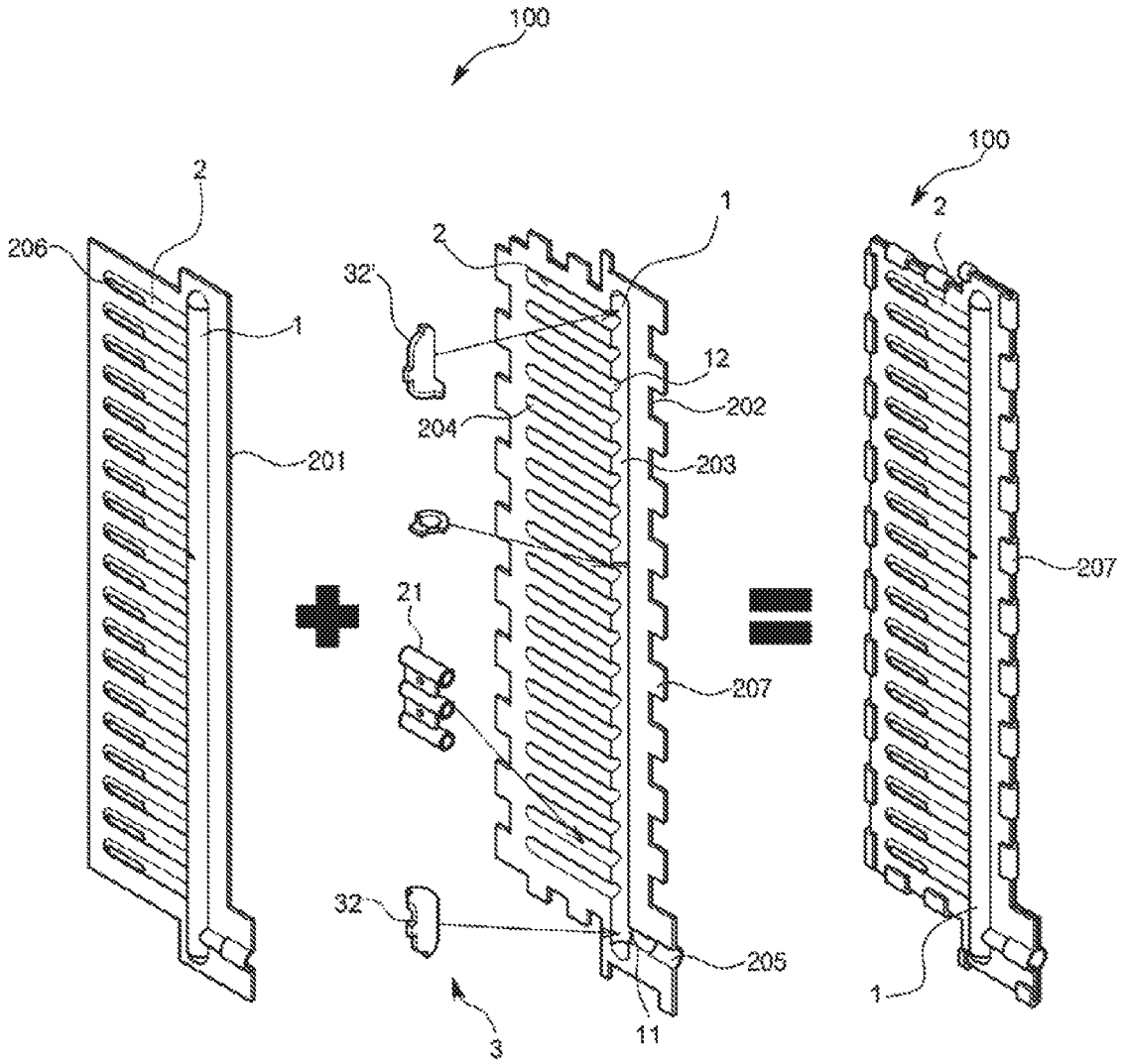
FIG. 22 is an exploded perspective view schematically illustrating a structure of a header according to an embodiment of the present disclosure.

As illustrated in FIG. 22, the header 100 may be configured such that at least two opposing press plates 201 and 202 having concave portions are combined so that cavities formed between the two press plates 201 and 202 form the main header chamber 1 and the sub header chambers 2 as described above. Referring to FIG. 22, each of the two press plates 201 and 202 is provided with a vertical concave portion 203 formed in the vertical direction and a plurality of horizontal concave portions 204 which are in fluid communication with the vertical concave portion 203 and are formed in parallel. A lower concave portion 205 formed in the horizontal direction opposite to the horizontal concave portions 204 is provided at the lower end of the vertical concave portion 203. When the two press plates 201 and 202 are coupled, the vertical concave portion 203 forms a main header chamber 1, the plurality of horizontal concave portions 204 form a plurality of sub header chambers 2, and the lower concave portion 205 forms a refrigerant inlet pipe. Further, the lower end of the vertical concave portion 203 may be provided with a bracket for forming a resistance body 32 as the flow direction changing mechanism 3. The upper end of the vertical concave portion 203 may be provided with a top resistance body 32' which is symmetrical with the resistance body 32. Also, the sub-header inserting tube 21 as described above may be disposed in the horizontal concave portions 204.

Further, as illustrated in FIG. 22, through holes 206 penetrating the press plate 201 in a sheet surface direction may be formed at positions of one press plate 201 where the plurality of sub header chambers 2 are formed. The above-described flat tubes 4 may be inserted into the through holes 206. Further, the other press plate 202 may be provided with a fixing portion 207 around the press plate 202 so that the two press plates 201 and 202 are coupled to each other. As illustrated in FIG. 22, the fixing portion 207 may be formed in a plurality of protrusions protruding from the outer circumference of the press plate 202.

Figure 23:
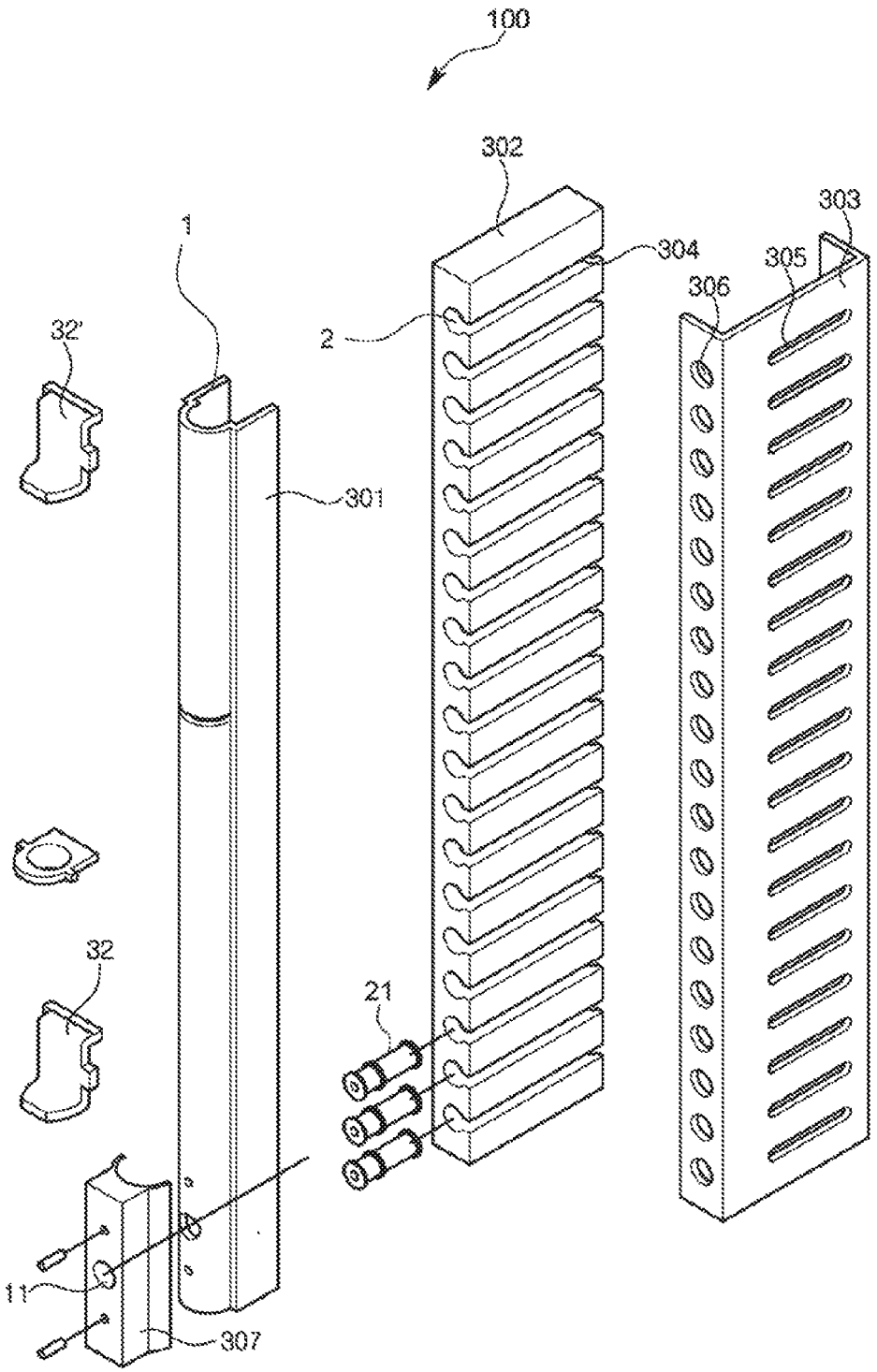
FIG. 23 is an exploded perspective view schematically illustrating a structure of a header according to an embodiment of the present disclosure.

As illustrated in FIG. 23, the main header chamber 1 and the plurality of sub header chambers 2 may be formed by combining extrusion-molded parts.

For example, as illustrated in FIG. 23, the plurality of sub header chambers 2 may be constituted of two extrusion-molded parts 302 and 303. In other words, a sub header block 302 having a plurality of sub header grooves 304 formed in the horizontal direction to constitute the sub header chambers 2 and a sub header cover 303 coupled to the sub header block 302 to cover the plurality of sub header grooves 304 are included. The sub header cover 303 is provided with a plurality of through holes 305 to which the flat tubes 4 are coupled in portions corresponding to the plurality of sub header grooves 304. Both sides of the sub header cover 303 extend to cover opposite side ends of the sub header block 302, and are provided with a plurality of through holes 306 in fluid communication with the plurality of sub header grooves 304. The main header chamber 1 may be formed by a main header cover 301 which is coupled to one side end of the sub header block 302 and the sub header cover 303 which are coupled to each other. A refrigerant inflow block 307 having the refrigerant inlet port 11 may be provided at the lower end of the main header cover 301. The main header cover 301 and the refrigerant inflow block 307 may be formed by extrusion molding. The main header chamber 1 may be provided with a resistance body 32 and at least one sub-header inserting tube 21.

Figure 24:
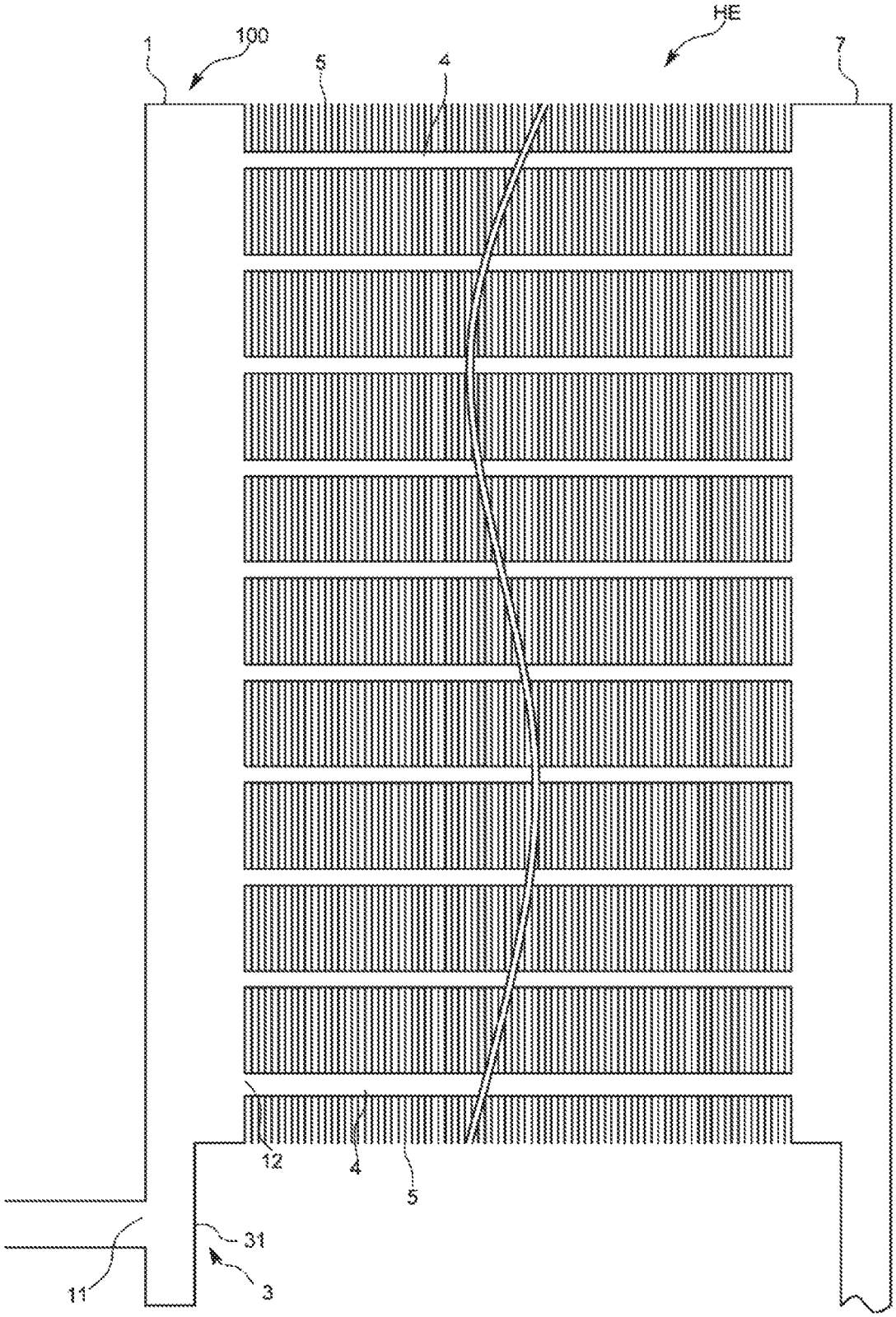
FIG. 24 is a view illustrating a structure of a header according to an embodiment of the present disclosure.

As illustrated in FIG. 24, the header 100 may be configured such that the refrigerant tubes, such as the plurality of flat tubes 4, etc., are directly connected to the main header chamber 1 without passing through the sub header chambers 2. In other words, in order to obtain the effect of the present disclosure, at least the header 100 may include any one of the flow direction changing mechanisms 3 described in the above-described embodiments. For example, a heat exchanger HE may be provided with the header 100 according to the present disclosure, a plurality of flat tubes 4 which are provided at predetermined intervals in the vertical direction and have refrigerant input ends connected to the header 100, a plurality of fins 5 provided between the plurality of flat tubes 4, and a header 7 connected to the refrigerant output ends of the plurality of flat tubes 4. The header 100 configured as described above may sufficiently deliver the refrigerant whose flow direction is changed by the above-described flow direction changing mechanism 3 to the upper portion inside the header 100, and may introduce the refrigerant sufficiently containing the liquid refrigerant into the flat tubes 4 disposed at the upper portion. As a result, the state of the refrigerant flowing through each of the plurality of flat tubes 4 may be made substantially uniform, so that the heat exchange efficiency may be improved.

Figure 25:
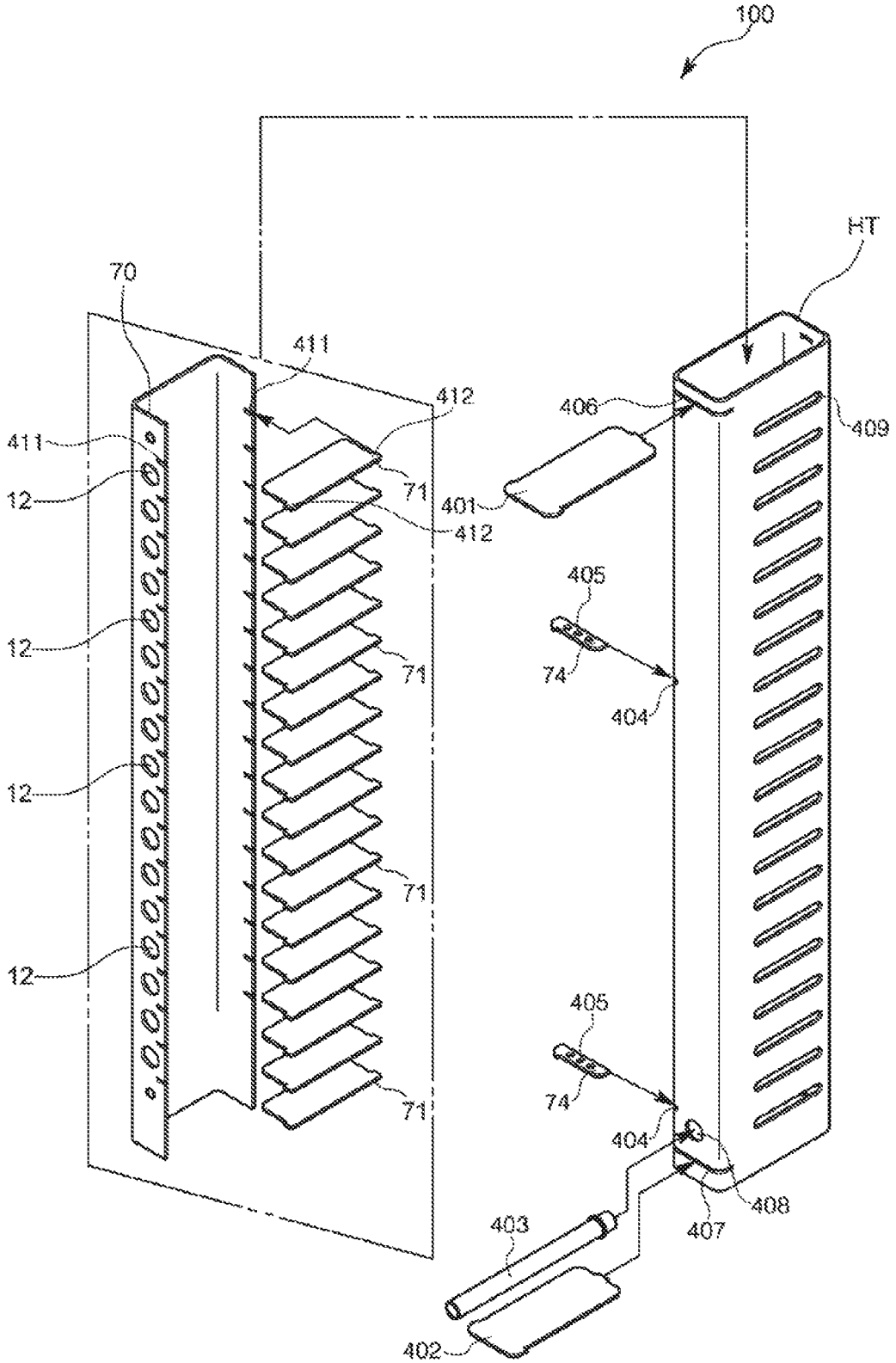
FIG. 25 is an exploded perspective view schematically illustrating a structure of a header according to an embodiment of the present disclosure.

As illustrated in FIG. 25, the header 100 may be formed by an insertion structure in which the header tube HT is formed of an electroseamed pipe, the first plate member 70 and the plurality of second plate members 71 are formed of press-processed plate materials, and the plurality of second plate members 71 are inserted into the first plate member 70. In detail, the electroseamed pipe has a rectangular cross-section with rounded corners, a pipe shape extending in the up-and-down direction having opposite open ends, and an insertion hole 408 into which a refrigerant inflow pipe 403 for forming the refrigerant inlet port 11 is inserted and which is formed on a lower portion of a side surface of the electroseamed pipe having a narrow width. Further, on the side surface of the electroseamed pipe having a wide width, flat-shaped holes 409 into which the plurality of flat tubes 4 are inserted are formed in parallel in the vertical direction at regular intervals. The first plate member 70 and the plurality of second plate members 71 are integrally assembled, and then are inserted at one end into the electroseamed pipe. An upper slot 406 into which an upper plate 401 is inserted is provided in the side surface having the narrow width of the upper end of the electroseamed pipe, and a lower slot 407 into which a lower plate 402 is inserted is provided in the side surface having the narrow width of the lower end of the electroseamed pipe. On an opposite side surface of the electroseamed pipe having the narrow width, an upper groove and a lower groove corresponding to the upper slot 406 and the lower slot 407 and supporting one end of the upper plate 401 and one end of the lower plate 402, respectively, are provided. Also, at least one throttling slot 404 into which a throttling plate 74 is inserted may be provided at the edge of the electroseamed pipe. The throttling plate 74 may be provided with a plurality of throttling holes 405.

The first plate member 70 is provided with the plurality of refrigerant outlet ports 12 and a plurality of coupling grooves 411, which are a part of the insertion structure and engaged with coupling protrusions 412 formed on the second plate members 71, at predetermined intervals in the vertical direction by press processing. The plurality of refrigerant outlet ports 12 and the coupling grooves 411 are formed on a plate member by press processing, and then the plate member is bent to have a substantially U-shaped cross-section such that the plurality of refrigerant outlet ports 12 are aligned with the narrow width side surface of the header tube HT.

On the other hand, the second plate members 71 is a plate member having a substantially rectangular shape, and is formed by press processing so that the coupling protrusion 412 engaging with the coupling grooves 411 of the first plate member 70 protrudes outward from opposite ends of the short sides thereof.

According to the structure as described above, the reliability with respect to the leakage of the refrigerant may be improved by removing the process of attaching the plurality of sub header tubes to the main header tube by brazing. Further, the complicated refrigerant distributing structure may be realized only by simple assembly without brazing process, so that the manufacturing cost may be greatly reduced.

Figure 26:
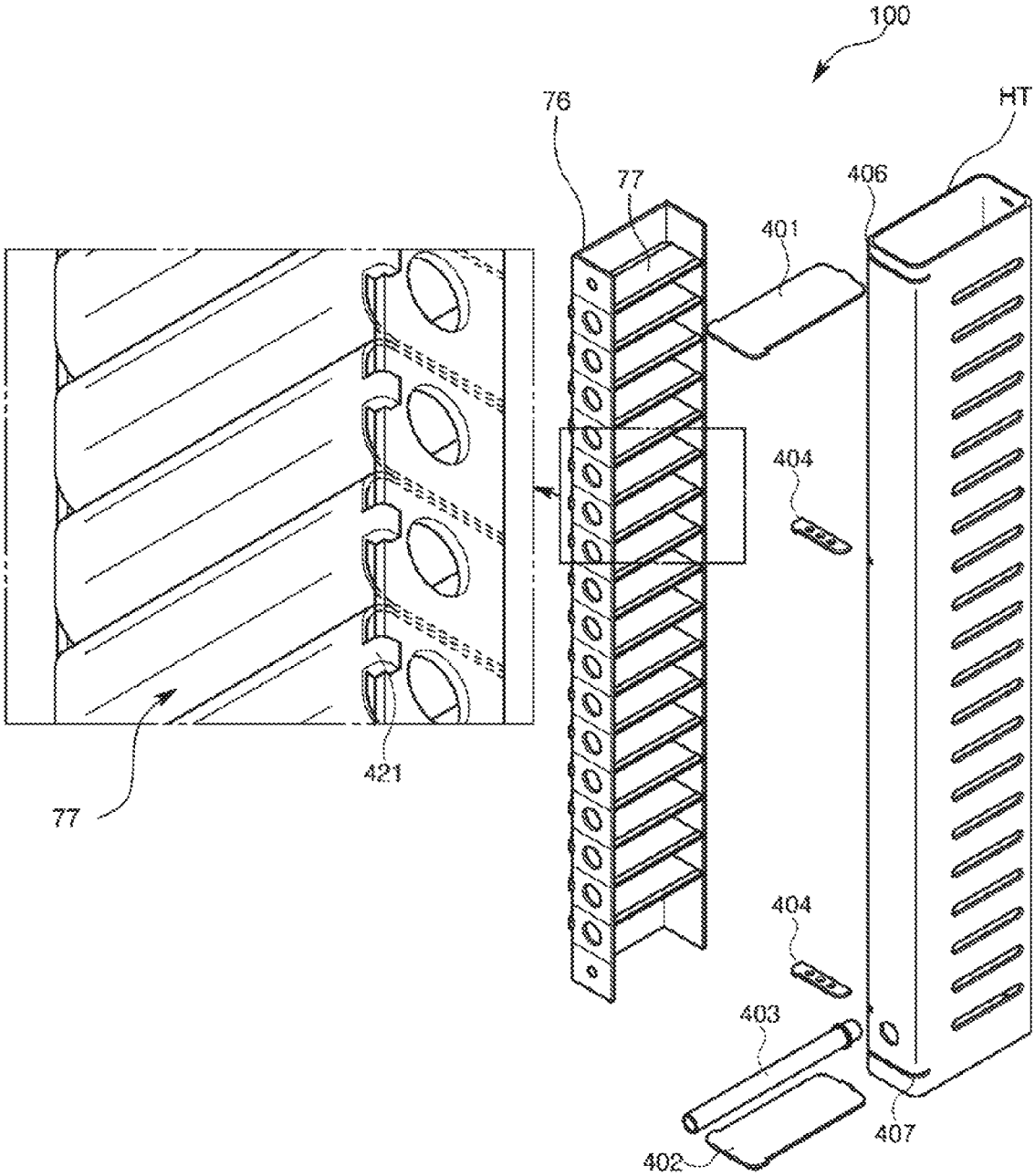
FIG. 26 is an exploded perspective view schematically illustrating a structure of a header according to an embodiment of the present disclosure.

An embodiment illustrated in FIG. 25 may be constituted by a member obtained by joining a plate member 76 having a substantially U-shaped cross-section to a corrugated member 77 formed by press processing, as illustrated in FIG. 26, in order to form the plurality of sub header chambers 2 as described above. The lower end of the corrugated member 77 is provided with fixing protrusions 421 for fixing the corrugated member 77 not to come off from the plate member 76. Accordingly, the corrugated member 77 is inserted into and joined to the plate member 76 having the substantially U-shaped cross-section, thereby forming the plurality of sub header chambers 2. Alternatively, the corrugated member 77 may be press-molded integrally with the plate member 76.

Figure 27:
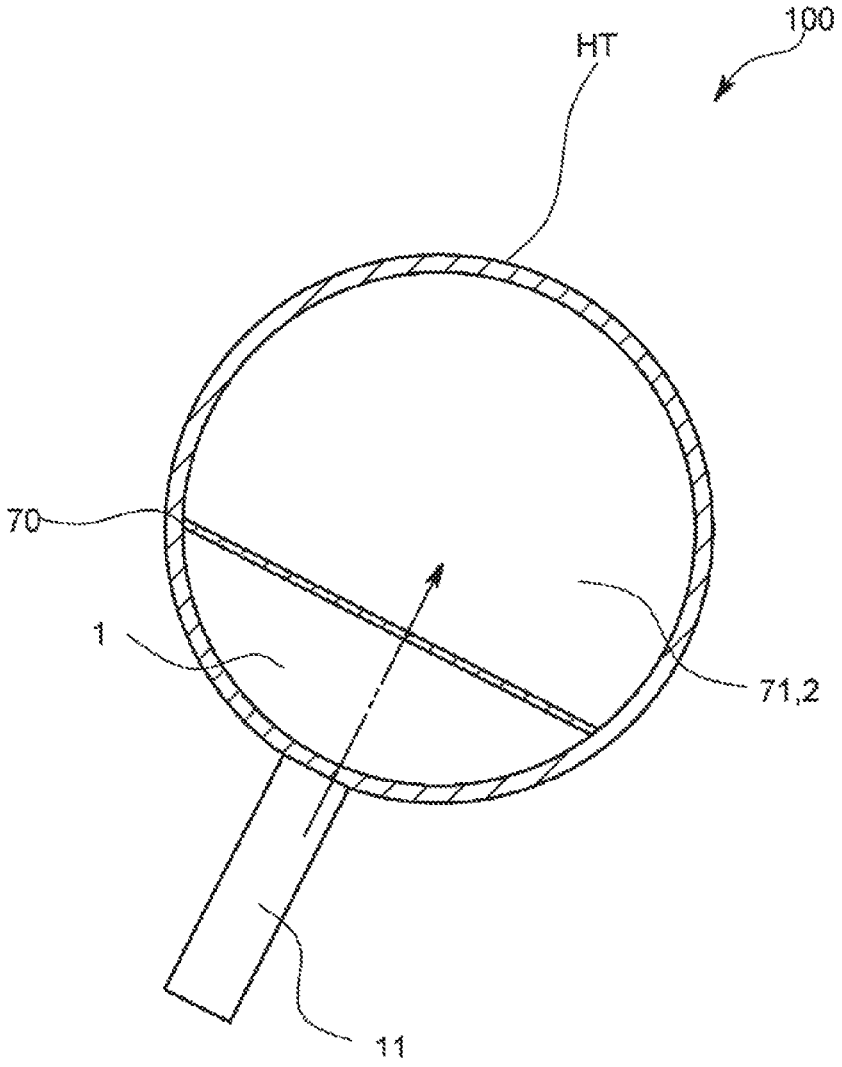
FIG. 27 is an exploded perspective view schematically illustrating a structure of a header according to an embodiment of the present disclosure.

As illustrated in FIG. 25, the shape of the header 100 is formed such that the flow path cross-section of the header tube HT is a substantially rectangular shape, and the first plate member 70 has a substantially U-shaped cross-section; however, the shape of the header 100 is not limited thereto. As illustrated in FIG. 27, the flow path cross-sectional shape of the header tube HT may be a substantially circular cross-section. At this time, the first plate member 70 forming the main header chamber 1 is formed in a flat plate shape, and the second plate members 71 forming the sub header chambers 2 may be formed in a flat plate shape having a shape corresponding to the circular arc section.

Figure 28:
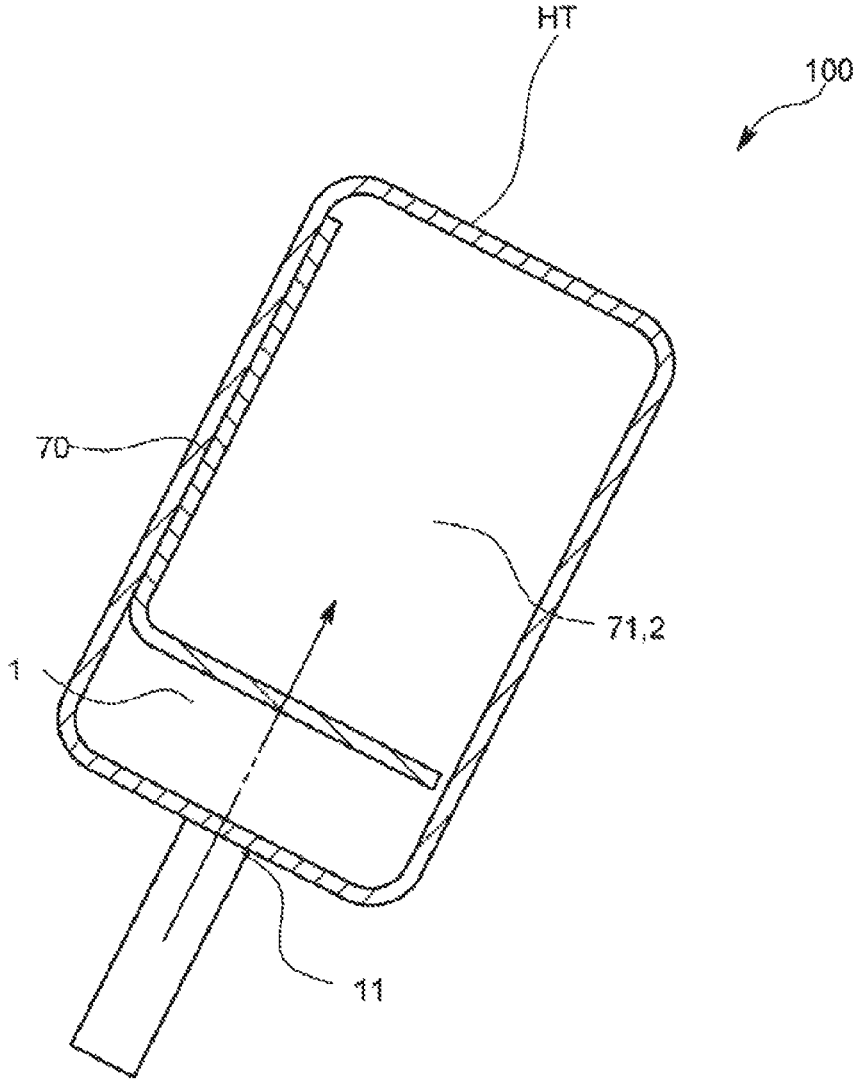
FIG. 28 is an exploded perspective view schematically illustrating a structure of a header according to an embodiment of the present disclosure.

As illustrated in FIG. 28, the flow path cross-sectional shape of the header tube HT is a substantially rectangular, and the first plate member 70 forming the main header chamber 1 is formed in a shape having a substantially L-shaped cross-section. Alternatively, the shape of the first plate member 70 may be formed in a flat plate. The second plate members 71 forming the sub header chambers 2 may be formed in a flat plate like the header as illustrated in FIG. 25.

Figure 29:
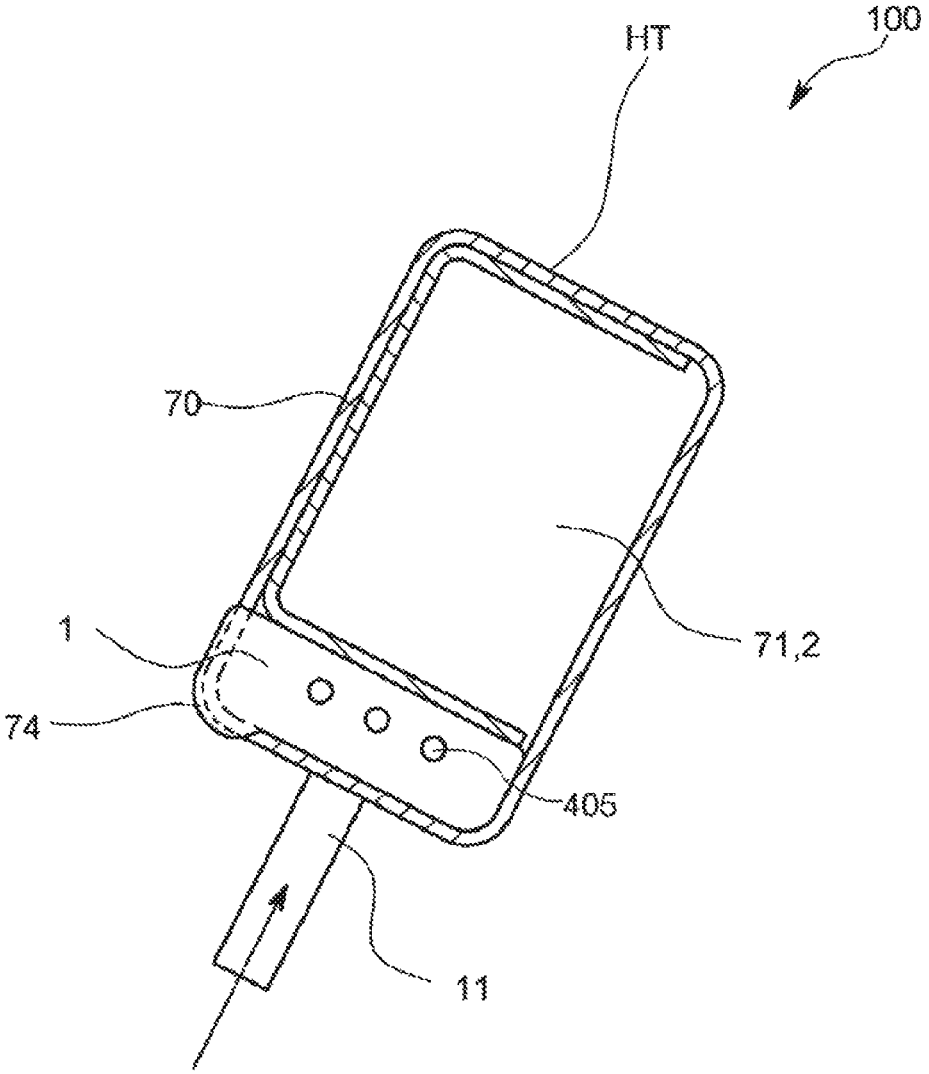
FIG. 29 is an exploded perspective view schematically illustrating a structure of a header according to an embodiment of the present disclosure.
Figure 30:
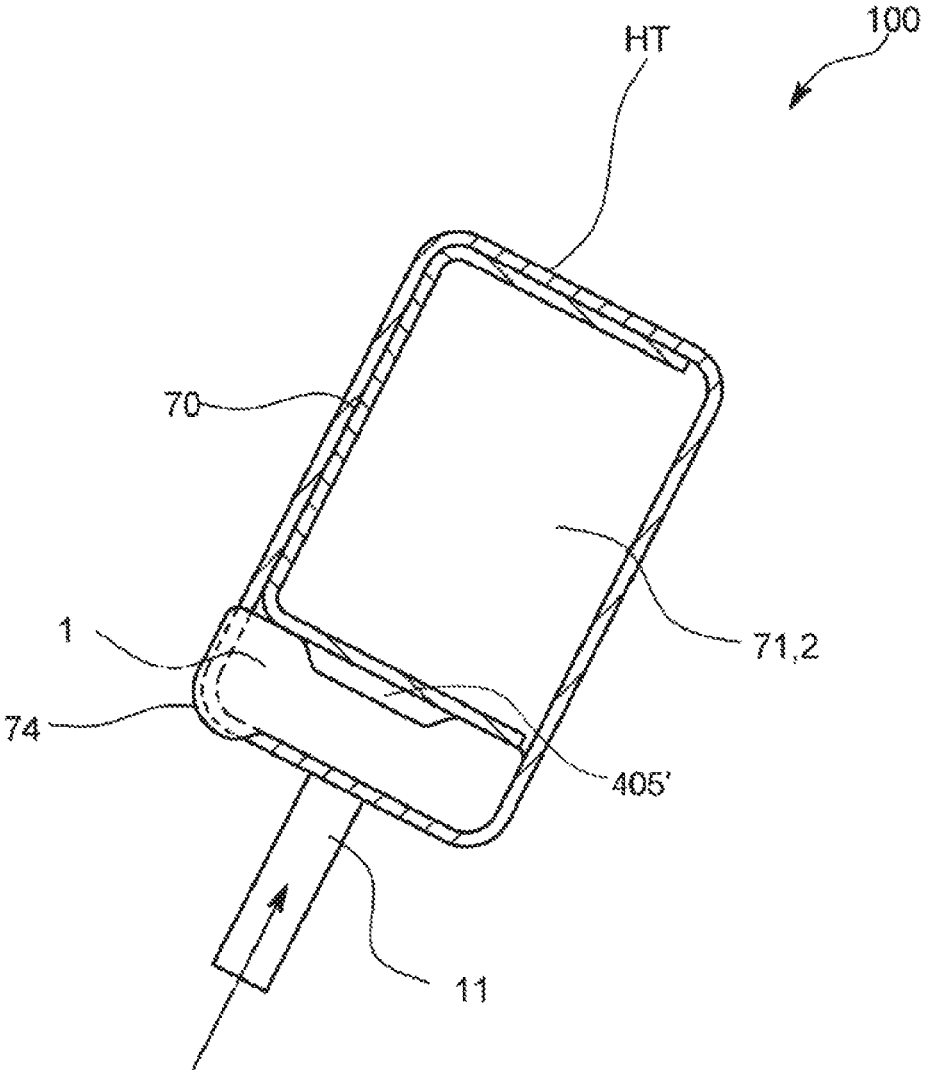
FIG. 30 is an exploded perspective view schematically illustrating a structure of a header according to an embodiment of the present disclosure.

As illustrated in FIG. 29, the throttling plate 74 disposed in the main header chamber 1 may be provided with substantially circular holes 405 or substantially polygonal holes formed in the plate. As illustrated in FIG. 30, the hole of the throttling plates 74 may be formed in a slit shape 405'.

Figure 31:
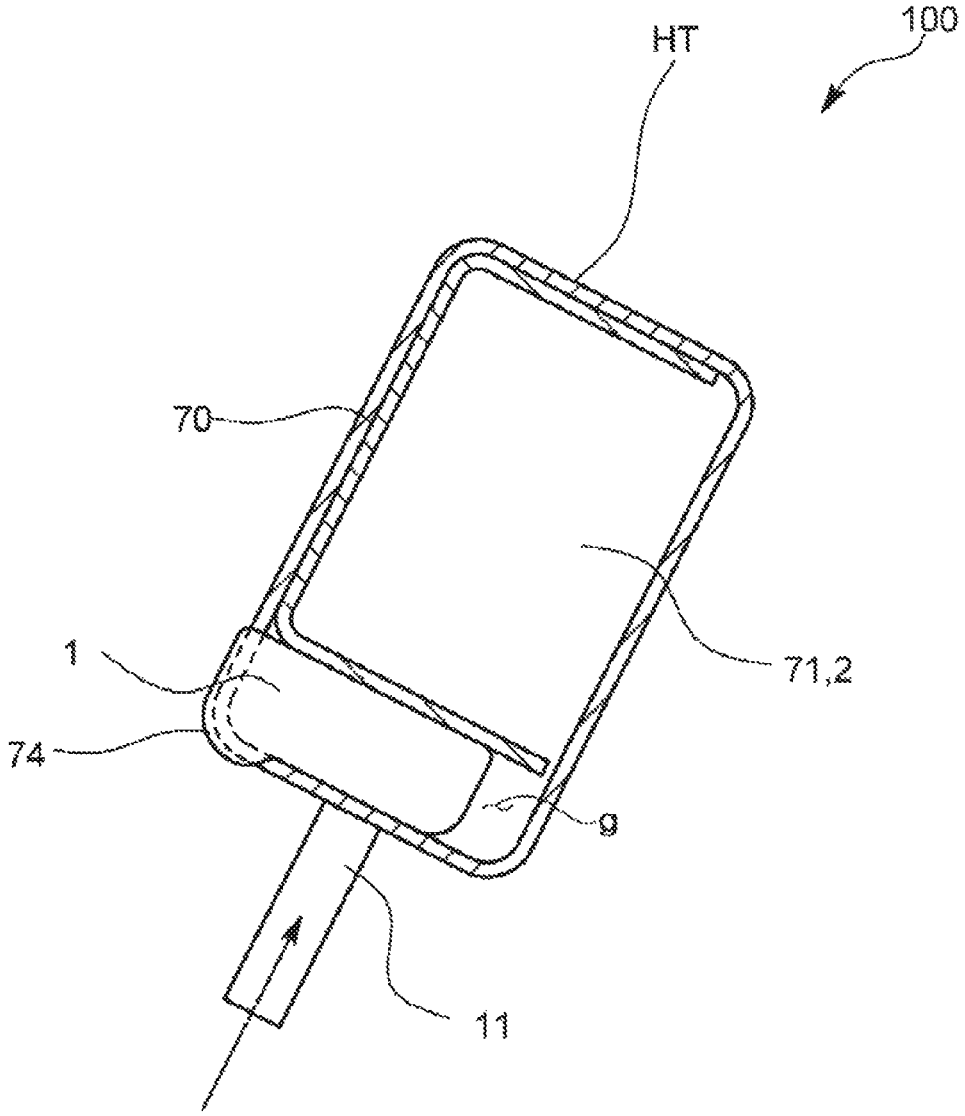
FIG. 31 is an exploded perspective view schematically illustrating a structure of a header according to an embodiment of the present disclosure.
Figure 32:
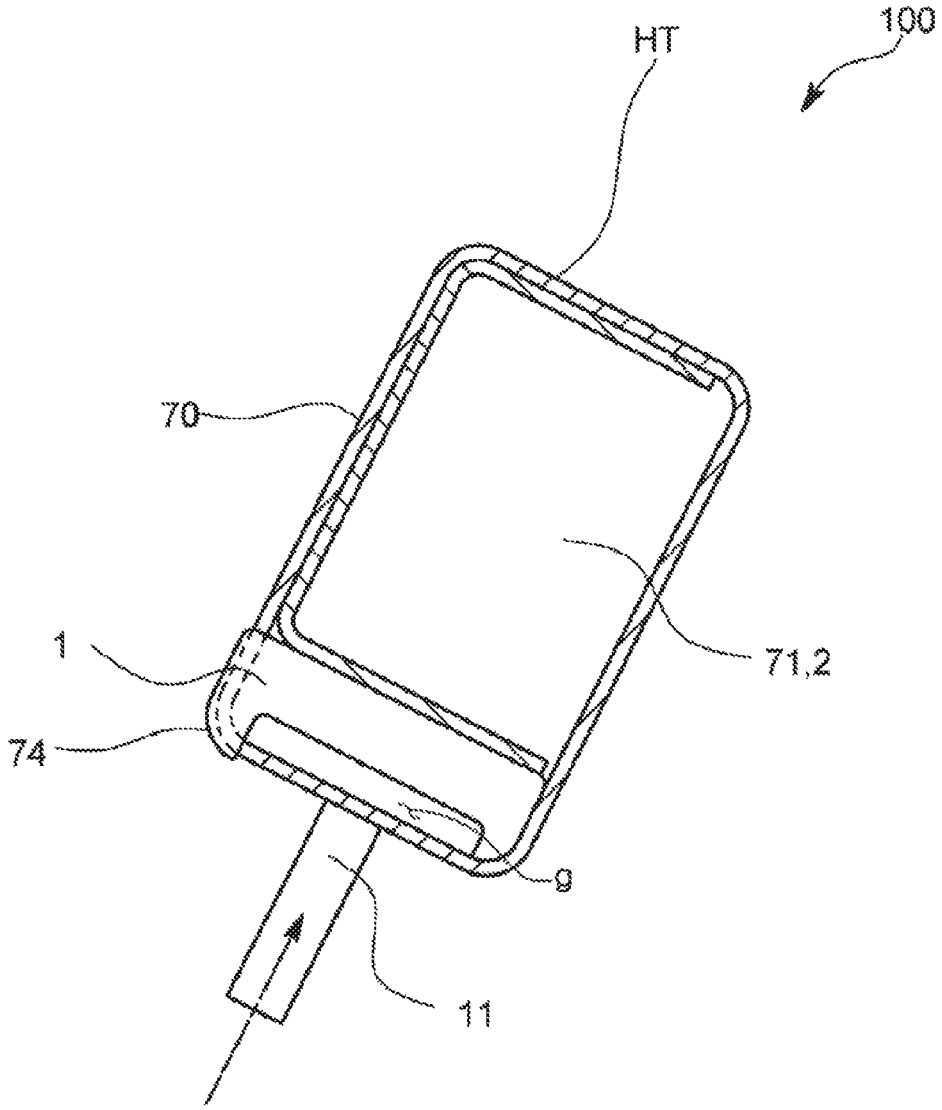
FIG. 32 is an exploded perspective view schematically illustrating a structure of a header according to an embodiment of the present disclosure.

As illustrated in FIGS. 31 and 32, a gap g may be provided between the inner surface of the electroseamed pipe and an end of the throttling plate 74 itself. In the case of FIG. 31, the length of the throttling plate 74 is formed to be shorter than the width of the header tube HT. Then, when the throttling plates 74 is inserted into the header tube HT, a gap g through which the refrigerant can pass is provided between one end of the throttling plate 74 and the inner surface of the header tube HT. In the case of FIG. 32, a groove is provided in a side surface of the throttling plate 74. In this case, when the throttling plates 74 is inserted into the header tube HT, a gap g through which the refrigerant can pass is provided between the inner surface of the header tube HT and the side surface of the throttling plate 74.

On the other hand, the heat exchanger HE according to the present disclosure is not limited to an air conditioner, and can be used in other refrigeration cycle apparatuses such as a refrigerator, for example.

In the above described embodiments, the flat tubes are used as the refrigerant tube; however, the kind of the refrigerant tube is not limited thereto. For example, a cylindrical tube used in a fin-and-tube heat exchanger may be provided in each sub header chamber 2.

While the embodiments of the present disclosure have been described, additional variations and modifications of the embodiments may occur to those skilled in the art once they learn of the basic inventive concepts. Therefore, it is intended that the appended claims shall be construed to include both the above embodiments and all such variations and modifications that fall within the spirit and scope of the disclosure.

What is claimed is:

1. An air conditioner comprising:

a plurality of refrigerant tubes provided in parallel; and a header configured to introduce a refrigerant into the plurality of refrigerant tubes, the header comprising:

a main header chamber communicating with the plurality of refrigerant tubes through a plurality of openings substantially aligned along a first surface of the main header chamber;

a refrigerant inlet port provided in a second surface of the main header chamber opposite to the first surface of the main header chamber, between a lowest internal surface of the main header chamber and the plurality of openings, and configured to introduce the refrigerant into the main header chamber; and a flow direction changing mechanism extending from the lowest internal surface of the main header chamber below the lowest refrigerant tube of the plurality of refrigerant tubes and offset from the first surface of the main header chamber in a direction toward the second surface of the main header chamber to form a third surface between the first surface and the second surface to receive the refrigerant directly from the refrigerant inlet port, and configured to change a flow of the refrigerant from the refrigerant inlet port from a horizontal direction to an upward direction as the refrigerant introduced from the refrigerant inlet port collides with the third surface of the flow direction changing mechanism so that most of the refrigerant from the refrigerant inlet port must travel in the upward direction to flow past the flow direction changing mechanism, wherein while the refrigerant flows toward an upper end of the main header chamber by the flow direction changing mechanism, the refrigerant flows into the plurality of refrigerant tubes and at least a portion of the refrigerant reaches the upper end of the main header chamber.

wherein the lowest internal surface of the main header chamber is perpendicular to the first surface and the second surface, wherein the flow direction changing mechanism is spaced apart from the second surface of the main header chamber in which the refrigerant inlet port is provided, and wherein the first surface of the main header chamber and the second surface of the main header chamber are parallel to each other.

2. The air conditioner of claim 1, wherein the header further comprises:

a plurality of sub header chambers branched substantially perpendicular to the main header chamber and provided in parallel, wherein each of the plurality of sub header chambers is respectively connected to each of the plurality of refrigerant tubes, and wherein the refrigerant introduced into the main header chamber is distributed into the plurality of refrigerant tubes through the plurality of sub header chambers.

3. The air conditioner of claim 2, wherein the main header chamber is formed by a main header tube, and the plurality of sub header chambers are formed by a plurality of sub header tubes connected to the main header tube.

4. The air conditioner of claim 2, wherein the main header chamber and the plurality of sub header chambers are provided inside a header tube, the main header chamber is formed by an inner surface of the header tube and a first plate member provided to partition the inside of the header tube, and the plurality of sub header chambers are formed by the inner surface of the header tube, the first plate member, and a plurality of second plate members provided to partition the inside of the header tube.

5. The air conditioner of claim 2, wherein the refrigerant inlet port is formed as an opening provided at the second surface of the main header chamber, and the flow direction changing mechanism is formed as a resistive body extending from an end portion of the main header chamber inside the main header chamber.

6. The air conditioner of claim 5, wherein the main header chamber further comprises:

a refrigerant flow path having a hydraulic diameter smaller than that of an opening of the refrigerant tube; and a plurality of refrigerant outlet ports connected to the plurality of sub header chambers, respectively, and formed in parallel, and wherein the plurality of sub header chambers do not protrude into the inside of the main header chamber from the plurality of refrigerant outlet ports.

7. The air conditioner of claim 6, wherein the resistive body is provided as a partition between the refrigerant inlet port and some of the plurality of refrigerant outlet ports.

8. The air conditioner of claim 6, wherein at least one of:

inner diameters of the plurality of sub header chambers are formed to gradually increase from a first portion to a second portion of the main header chamber, and the plurality of sub header chambers are divided into at least two groups, and the inner diameters of the plurality of sub header chambers included in each of the at least two groups are formed to gradually increase from the first portion to the second portion of the main header chamber by group.

9. The air conditioner of claim 6, the main header chamber further comprises:

at least one tubular member provided inside the main header chamber and including a first end opened, a second end covered by a cover having a hole, and a side surface on which a plurality of communication holes capable of fluid communication with the plurality of sub header chambers are formed, and a first stopper and a second stopper provided on an inner wall of the main header chamber so that the tubular member is capable of moving in the main header chamber between the first stopper and the second stopper.

10. The air conditioner of claim 9, wherein at a position where the tubular member is in contact with the first stopper, the plurality of communication holes of the tubular member are not in communication with the plurality of sub header chambers, and at a position where the tubular member is in contact with the second stopper, the plurality of communication holes of the tubular member are in communication with the plurality of sub header chambers.

11. The air conditioner of claim 6, wherein the refrigerant inlet port of the main header chamber is provided not to face the refrigerant outlet ports.

12. The air conditioner of claim 5 further comprising:

a sub-header inserting tube inserted into at least one of the plurality of sub header chambers, wherein an end of the sub-header inserting tube protrudes into the main header chamber.

13. The air conditioner of claim 12, wherein each of the plurality of sub header chambers is provided with the sub-header inserting tube such that a plurality of sub-header inserting tubes respectively correspond to the plurality of sub header chambers, and at least one of:

inner diameters of the plurality of sub-header inserting tubes are formed to gradually increase from a first portion to a second portion of the main header chamber, and the plurality of sub-header inserting tubes are divided into at least two groups, the inner diameters of the plurality of sub header inserting tubes included in each of the at least two groups are formed to gradually increase from the first portion to the second portion of the main header chamber by group.

14. The air conditioner of claim 2, wherein the refrigerant inlet port is formed as an opening provided at the second surface of the main header chamber, and the flow direction changing mechanism is formed integrally with the first surface of the main header chamber facing the refrigerant inlet port.

15. The air conditioner of claim 14, wherein at least one of the plurality of sub header chambers includes more than one of the plurality of refrigerant tubes.

16. The air conditioner of claim 2, wherein at least one of the plurality of sub header chambers is connected to the main header chamber through a throttling portion having a narrow flow path.

17. The air conditioner of claim 16, wherein the inside of the main header chamber is partitioned by at least one throttling plate provided with the throttling portion.

18. The air conditioner of claim 16, wherein each of the plurality of sub header chambers is provided with the throttling portion such that a plurality of throttling portions respectively correspond to the plurality of sub header chambers, and at least one of:

inner diameters of the plurality of throttling portions are formed to gradually increase from a first portion to a second portion of the main header chamber, and the plurality of throttling portions are divided into at least two groups, and the inner diameters of the plurality of throttling portions included in each of the at least two groups are formed to gradually increase from the first portion to the second portion of the main header chamber by group.

19. The air conditioner of claim 1, wherein a longitudinal section of the main header chamber is formed in one of a trapezoidal shape, a triangular-pyramid shape, and a conical shape, and a width of a first end of the main header chamber farthest from the refrigerant inlet port is smaller than a width of a second end of the main header chamber nearest to the refrigerant inlet port.

20. A heat exchanger comprising:

a plurality of refrigerant tubes; and a header configured to be in fluid communication with the plurality of refrigerant tubes, the header comprising:

a refrigerant inlet port configured to receive a refrigerant;

a main header chamber configured to be in fluid communication with the refrigerant inlet port provided in a first surface of the main header chamber, and in fluid communication with the plurality of refrigerant tubes through a plurality of openings substantially aligned along a second surface of the main header chamber opposite to the first surface of the main header chamber, wherein the refrigerant inlet port is provided between a lowest internal surface of the main header chamber and the plurality of openings; and a flow direction changing mechanism extending from the lowest internal surface of the main header chamber below the lowest refrigerant tube of the plurality of refrigerant tubes and offset from the second surface of the main header chamber in a direction toward the first surface of the main header chamber to form a third surface between the first surface and the second surface and between the refrigerant inlet port and the plurality of refrigerant tubes to receive the refrigerant directly from the refrigerant inlet port, and configured to change a direction of the refrigerant entering the main header chamber from the refrigerant inlet port from a horizontal direction to an upward direction as the refrigerant introduced from the refrigerant inlet port collides with the third surface of the flow direction changing mechanism so that most of the refrigerant from the refrigerant inlet port must travel in the upward direction to flow past the flow direction changing mechanism, wherein the flow direction changing mechanism is at least one of integrally formed with the refrigerant inlet port, integrally formed with the main header chamber, and separately provided from the refrigerant inlet port and the main header chamber, wherein while the refrigerant flows toward an upper end of the main header chamber by the flow direction changing mechanism, the refrigerant flows into the plurality of refrigerant tubes and at least a portion of the refrigerant reaches the upper end of the main header chamber, wherein the lowest internal surface of the main header chamber is perpendicular to the first surface and the second surface, wherein the flow direction changing mechanism is spaced apart from the first surface of the main header chamber in which the refrigerant inlet port is provided, and wherein the first surface of the main header chamber and the second surface of the main header chamber are parallel to each other.

* * * * *